US010874227B1

(12) United States Patent
He et al.

(10) Patent No.: US 10,874,227 B1
(45) Date of Patent: Dec. 29, 2020

(54) STRIP LIGHT USED IN SHOWCASE

(71) Applicants: Self Electronics Co., Ltd., Zhejiang (CN); Wanjiong Lin, Zhejiang (CN); Self electronics USA Corporation, Norcross, GA (US)

(72) Inventors: Zuping He, Zhejiang (CN); Huangfeng Pan, Zhejiang (CN); Quan Zhu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/706,070

(22) Filed: Dec. 6, 2019

(30) Foreign Application Priority Data

Nov. 1, 2019 (CN) ..... 2019 1 1058380

(51) Int. Cl.

| | |
|---|---|
| ***F21V 7/00*** | (2006.01) |
| ***A47F 3/00*** | (2006.01) |
| ***F21S 4/20*** | (2016.01) |
| ***F21V 5/04*** | (2006.01) |
| *F21Y 115/10* | (2016.01) |
| *F21W 131/405* | (2006.01) |

(52) U.S. Cl.
CPC ..... *A47F 3/001* (2013.01); *F21S 4/20* (2016.01); *F21V 5/045* (2013.01); *F21V 7/0008* (2013.01); *F21V 7/0091* (2013.01); *F21W 2131/405* (2013.01); *F21Y 2115/10* (2016.08)

(58) Field of Classification Search
None
See application file for complete search history.

(56) References Cited

U.S. PATENT DOCUMENTS

2014/0126205 A1* 5/2014 Davis ..... F21V 31/03 362/244

* cited by examiner

*Primary Examiner* — Vip Patel
(74) *Attorney, Agent, or Firm* — Wang Law Firm, Inc.

(57) ABSTRACT

A strip light used in showcase, comprising strip light holder; circuit board; at least three light sources; at least three optical components; the optical components comprising first light splitting member, including two first light splitting surfaces distributed on two sides of the optical axis of the light source; the first light splitting surface directs light of the light source at the optical axis and its vicinity outward along the width direction of the strip light holder and projects the light to the distal end of the illumination surface; light stretching member, being located between two adjacent groups of first light splitting members, and used for diffusing the light of the light source along the length direction of the strip light holder and projecting it onto the illumination surface directly in front of the first light splitting member of the adjacent group.

19 Claims, 30 Drawing Sheets

STRIP LIGHT USED IN SHOWCASE

RELATED APPLICATION

This application claims priority to Chinese Patent Application No. CN 201911058380.3, filed on Nov. 1, 2019.

FIELD OF THE TECHNOLOGY

The present invention relates to the technical field of lighting fixtures, with particular emphasis on a strip light used in showcase.

BACKGROUND OF THE INVENTION

At present, the vertical cabinets or showcase cabinets are provided with lighting lamps, but most of them are installed at the top of the cabinet body. If there are multiple compartments in the vertical cabinets and showcase cabinets, the lighting lamps cannot illuminate the lower part of the vertical cabinet or the showcase cabinet. Or the current vertical cabinet or showcase cabinet is provided with lighting lamps in each compartment. Although each compartment has light illumination, the multilayers are provided with lighting lamps, which cause waste of resources.

Specifically, the refrigerated showcase has a door frame assembly mounted at the front of the showcase, which includes the corresponding side frame members, and a top frame member and a bottom frame member that are interconnected with the side frame members, respectively. The door is hinged to these frame members. The mullion is mounted to the top and bottom frame members. Known LED illumination systems for illuminating showcases are typically designed to provide a longitudinal distance that is the vertical distance between the light source and the illumination surface, which is the plane to be illuminated. In order to simultaneously illuminate the illumination surfaces on both sides of the mullion, researchers have proposed strip lights that illuminate on both sides. Although this kind of LED strip light can achieve double-sided light output and realize the lighting requirements between two adjacent compartment of the vertical cabinet or showcase. But it needs to use two rows of light sources to illuminate the two sides, the manufacturing cost is high and the structure is more complicated.

BRIEF SUMMARY OF THE INVENTION

In view of the above, it is necessary to provide a strip light used in showcase to overcome the above disadvantages.

A strip light used in showcase, comprising:

strip light holder, disposed opposite to the illumination surface;

circuit board, disposed on the strip light holder, provided with a light source mounting surface toward the illumination surface;

at least three light sources, disposed spaced along the length direction of the strip light holder on the light source mounting surface, and optical axis of the light source are perpendicular to the circuit board;

at least three optical components, respectively disposed corresponding to each of the light sources;

characterized in that, the optical components comprise:

first light splitting member, provided with at least two groups, at least one of which is provided in each group, and including two first light splitting surfaces distributed on two sides of the optical axis of the light source; the first light splitting surface directs light of the light source at the optical axis and its vicinity outward along the width direction of the strip light holder and projects the light to the distal end of the illumination surface;

light stretching member, provided with at least one group, at least one of which is provided in each group, each group being located between two adjacent groups of first light splitting members, and used for diffusing the light of the light source along the length direction of the strip light holder and projecting it onto the illumination surface directly in front of the first light splitting member of the adjacent group.

Advantageously, the first light splitting member adopts light splitting lens, the first light splitting member includes a first light splitting surface, which is total reflection surface; the first light splitting member further includes a first light incident surface disposed in a light emitting direction of the light source and a first light emitting surface distributed on two sides of the optical axis of the light source; the first light splitting surface is located above the first light incident surface along the light emitting direction of the light source, and the first light emitting surface is located outside of the first light splitting surface in the same side.

Advantageously, the bottom surface of the first light splitting member is provided with a first counter bore for accommodating the light source, and the inner wall of the first counter bore forms first light incident surface.

Advantageously, the first light splitting surface is curved focusing surface along the length direction of the strip light holder.

Advantageously, the first counter bore includes arch top surface extending in the width direction of the strip light holder and side surface disposed on both sides of the longitudinal direction of the arch top surface, and most of the light passing through the arch top surface is refracted to the first light splitting surface, and most of the light passing through the side surface is refracted to the first light emitting surface.

Advantageously, the first light emitting surface is perpendicular to the light source mounting surface.

Advantageously, the first light splitting member further includes a first collimating surface disposed between the first light incident surface and the first light emitting surface to totally reflect the large-angle light of the light source to the first light splitting surface.

Advantageously, the first collimating surface is a rotation surface with the optical axis as a central axis.

Advantageously, the first light splitting surface is a flat surface extending in the longitudinal direction of the strip light holder.

Advantageously, the first counter bore includes a cylindrical surface extending in a direction perpendicular to the light source mounting surface and a dome surface for focusing light, and the light passing through the dome surface is mostly refracted to the first light splitting surface, and the light passing through the cylindrical surface is mostly refracted to the first collimating surface.

Advantageously, the first light emitting surface is perpendicular to the light source mounting surface.

Advantageously, the first light splitting member uses a reflector uses a reflector with the first light splitting surface as a reflecting surface.

Advantageously, the light stretching member is perpendicular to the first light splitting member in the light splitting direction and includes two second light splitting surfaces distributed on two sides of the optical axis of the light source; the second light splitting surface guides the light of the light source at the optical axis and its vicinity outward in the longitudinal direction of the strip light holder and projected it onto the illumination surface directly in front of first light splitting member in the adjacent groups.

Advantageously, the light stretching member adopts light splitting lens, the light stretching member comprises second light splitting surface, which is total reflection surface, and the light stretching member further comprises a second light incident surface disposed in a light emitting direction of the light source and two second light emitting surface distributed on both sides of the optical axis of the light source, the second light splitting surface is located above the second light incident surface along the light emitting direction of the light source, and the second light emitting surface is located outside of the second light splitting surface on the same side.

Advantageously, a bottom surface of the light stretching member is provided with a second counter bore for accommodating the light source, and the inner wall of the second counter bore forms the second light incident surface.

Advantageously, the second light splitting surface is a curved focusing surface along the longitudinal direction of the strip light holder.

Advantageously, the light stretching member further includes a second collimating surface disposed between the second light incident surface and the second light emitting surface fully reflected the large angle light of the light source to the second light splitting surface.

Advantageously, the second collimating surface is a rotation surface with the optical axis as a central axis.

Advantageously, the second light splitting surface is a flat surface extending in the width direction of the strip light holder.

Advantageously, the light stretching member uses a reflector with the second light splitting surface as a reflecting surface.

Advantageously, the light stretching member uses a light stretching lens, the light stretching member comprises a second light incident surface and two second light stretching surface distributed on both sides of the optical axis of the light source; the second light stretching surface diffuses light outward along the length direction of the strip light holder and projects the light onto the illumination surface directly in front of the adjacent first light splitting member.

Advantageously, the second light stretching surface focus the light along the width direction of the strip light holder.

Advantageously, the bottom surface of the light stretching member is provided with a third counter bore for accommodating the light source, and the inner wall of the third counter bore forms the second light incident surface.

The technical effect of the invention:

The strip light used in showcase of the present invention, a part of the optical component splits the light of the single row of light sources along the width direction of the lamp body to the distal end of the illumination surface, thereby increasing the illumination range, and the other part of the optical component stretches the illumination range of the other part of the light source along the length direction of the lamp body, thereby filling the dark area on the illumination surface due to the splitting, and obtaining an illumination effect with a large illumination range and no dark area.

BRIEF DESCRIPTION OF THE DRAWINGS

The drawings described herein are intended to promote a further understanding of the present invention, as follows.

DETAILED DESCRIPTION OF THE INVENTION

Figure 1:
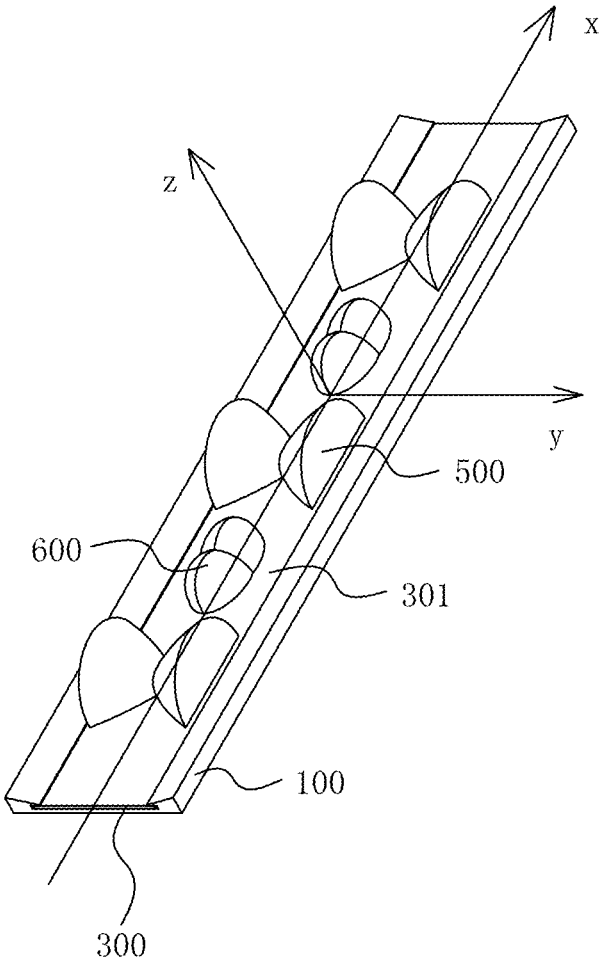
FIG. 1 is a schematic diagram of the three-dimensional structure of a strip light used in showcase of the first embodiment.
Figure 2:
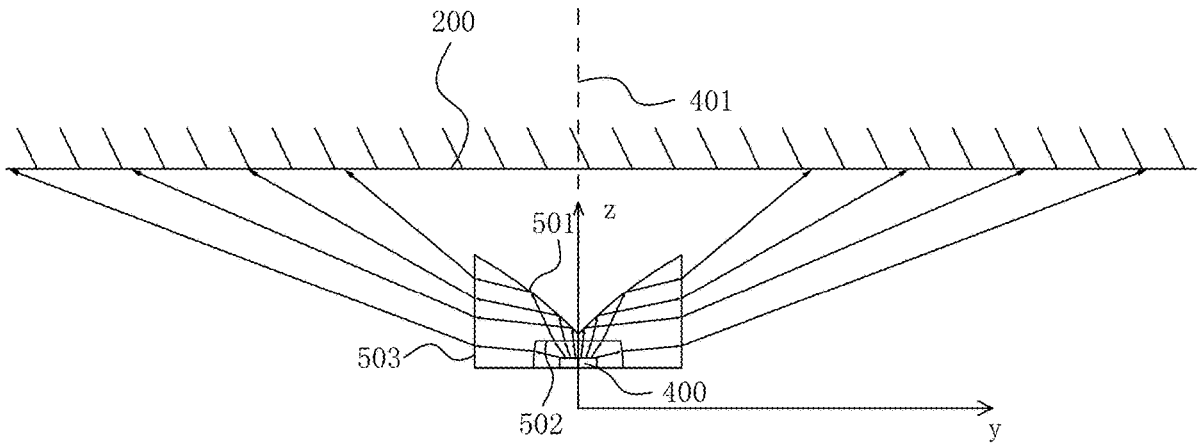
FIG. 2 is a light path diagram showing a cross section of first light splitting member of the first embodiment in the longitudinal direction of the vertical lamp body.
Figure 3:
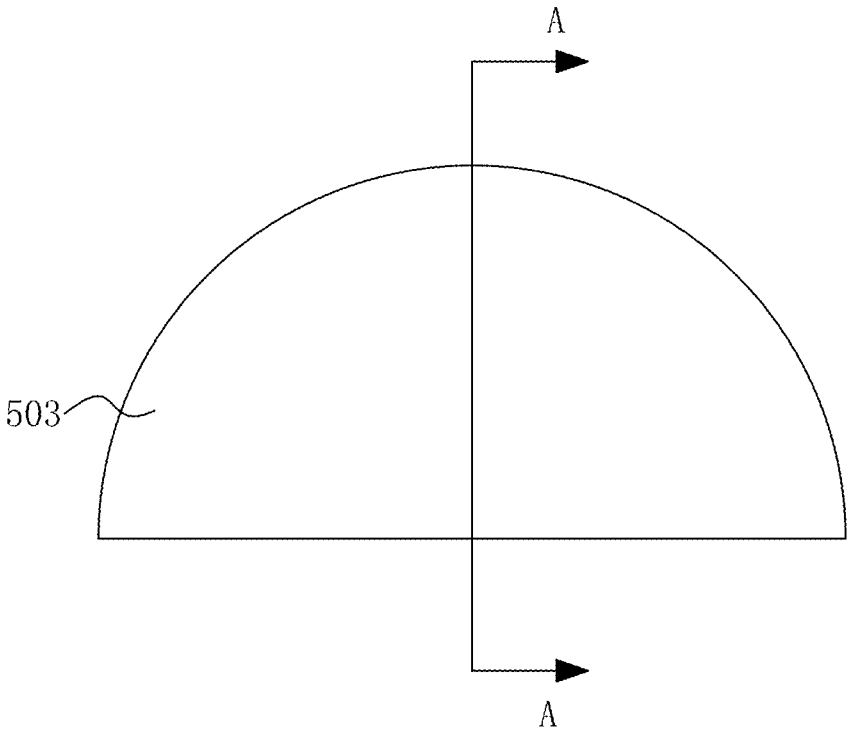
FIG. 3 is a schematic structural view of first light splitting member of the first embodiment.
Figure 4:
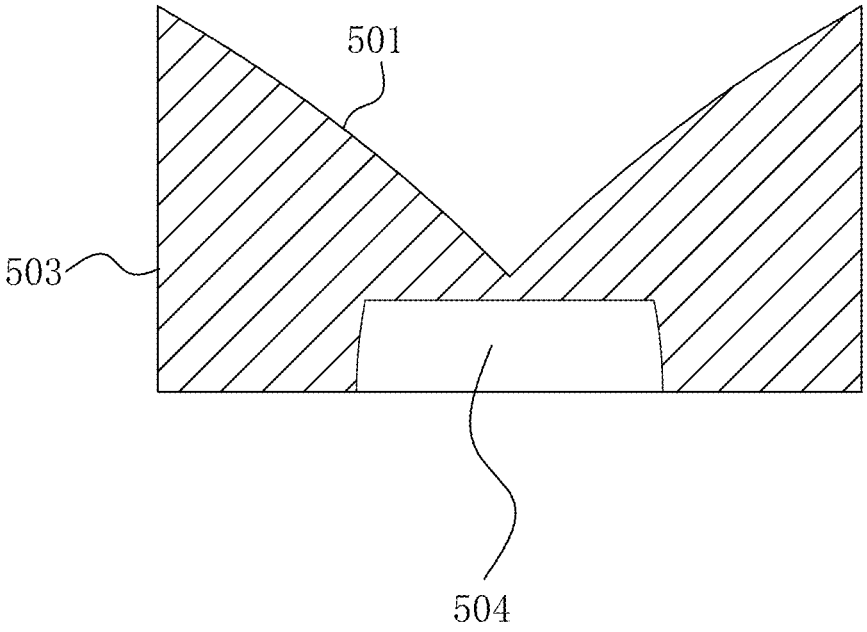
FIG. 4 is a cross-sectional view in the A-A direction of first light splitting member of FIG. 3.
Figure 5:
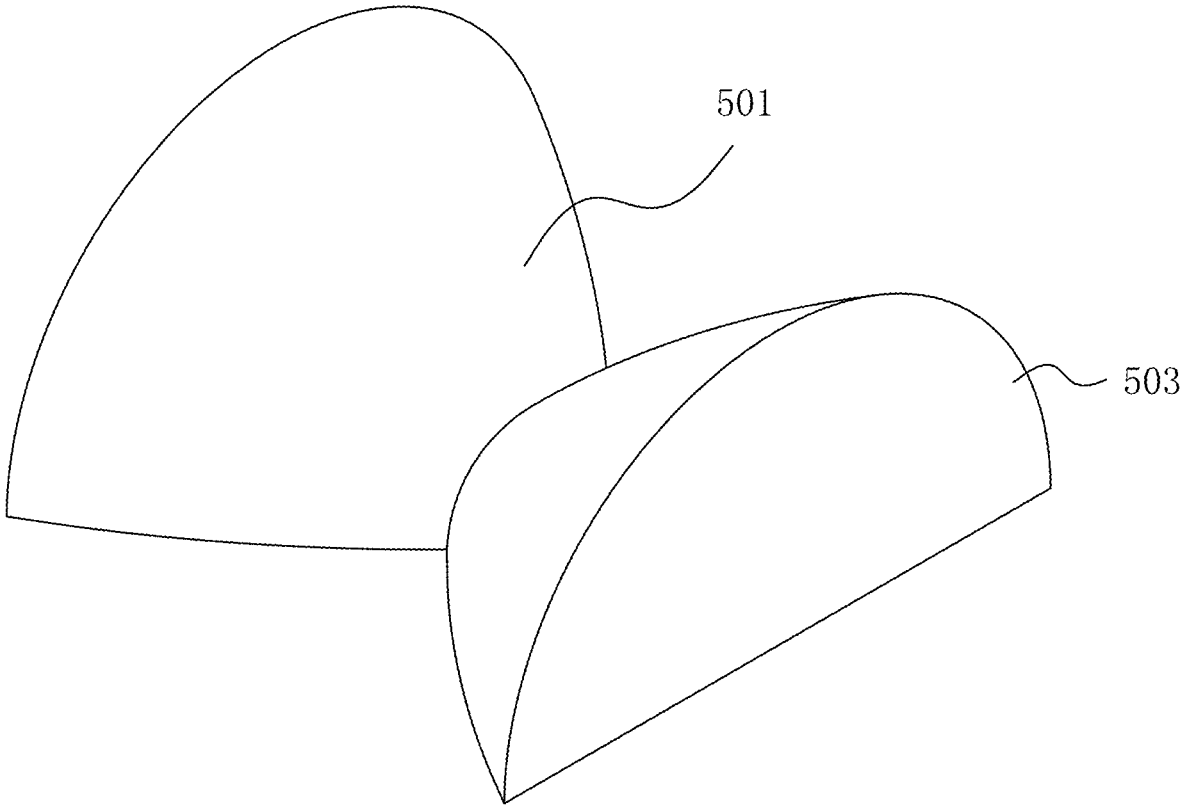
FIG. 5 is a schematic perspective view showing the first light splitting member of the first embodiment at a viewing angle.
Figure 6:
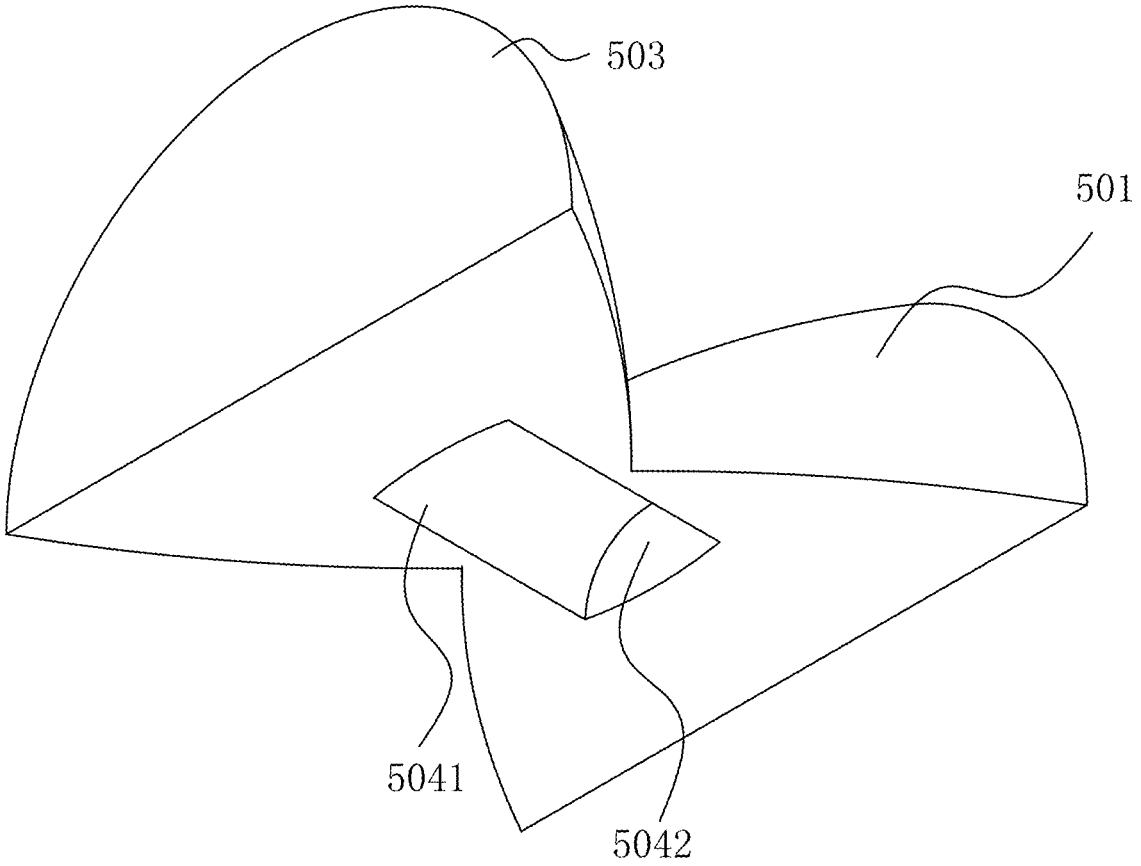
FIG. 6 a schematic perspective view showing the first light splitting member of the first embodiment at another viewing angle.

The present application is illustrated by way of the following detailed description based on of the accompanying drawings. It should be noted that illustration to the embodiment in this application is not intended to limit the invention.

Embodiment 1

As shown in FIG. 1-13, the strip light used in showcase of the present embodiment comprises strip light holder 100, circuit board 300, light source 400, and optical component.

The strip light of the embodiment is used in a showcase, in particular in a refrigerated display case. The strip light is mounted on a vertical or a horizontal frame on the inner side of the showcase, and then a certain longitudinal distance is set with the illumination surface 200 to realize the lighting of the goods.

In this embodiment, the strip light holder 100 is disposed opposite to the illumination surface 200, and the circuit board 300 is disposed on the strip light holder 100 and provided with a light source mounting surface 301 toward the illumination surface 200, and at least three light sources 400 are disposed spaced along the length direction of the strip light holder 100 on the light source mounting surface 301, and the optical axis of the light source are perpendicular to the circuit board 300. The above structure is a prior art, and in order to achieve uniformity of illumination, optical components are generally disposed corresponding to each of the light sources 400, thereby achieving the desired illumination effect. From the perspective of energy saving and high efficiency, the light source 400 adopts LED chip, and the structure of heat dissipation cavity, patch cord and end cover are generally disposed in the strip light holder 100, which are not the focus of the present application and can be selected according to the needs in the prior art, so it is unnecessary to mention here.

In order to achieve illumination on both sides in the width direction of the strip light, the optical component comprises first light splitting member 500, and the first light splitting member 500 is provided with at least two groups, at least one of which is provided in each group, the purpose of the first light splitting member 500 is to achieve large-angle illumination, at least two groups can be set to achieve illumination of a certain area in the length direction of the lamp body (the mullion or the length direction of the horizontal frame). In each group, one or more can be used to form corresponding to the same number of light sources 400, which is generally related to the length of the lighting.

The first light splitting member 500 includes two first light splitting surfaces 501 distributed on two sides of the optical axis of the light source 400. The first light splitting surface 501 directs the light of the light source 400 at the optical axis 401 and its vicinity outward along the width direction of the strip light holder 100 and projects it to the distal end of the illumination surface 200. By setting the two first light splitting surfaces 501, light located at the optical axis 401 and its vicinity are split outward along the width direction of the strip light holder 100, thus, a large angle of illumination can be achieved, and a large lighting range can be achieved at the illumination surface 200.

Figure 7:
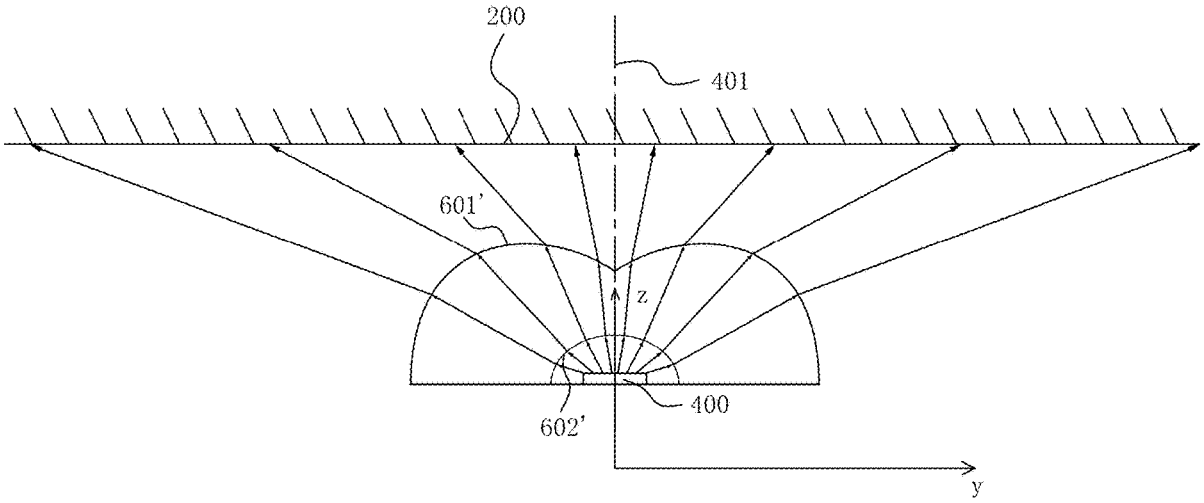
FIG. 7 is a light path diagram of a cross section of the light stretching member of the first embodiment in the width direction of the vertical lamp body.

However, since the light rays at the optical axis 401 and in the vicinity thereof are split, dark regions are formed in the corresponding region, that is, the illumination surface 200 directly in front of the two first light splitting surfaces 501 forms a dark region, resulting in uneven brightness of the illumination surface, affecting the lighting effect, as shown in FIG. 7.

Figure 8:
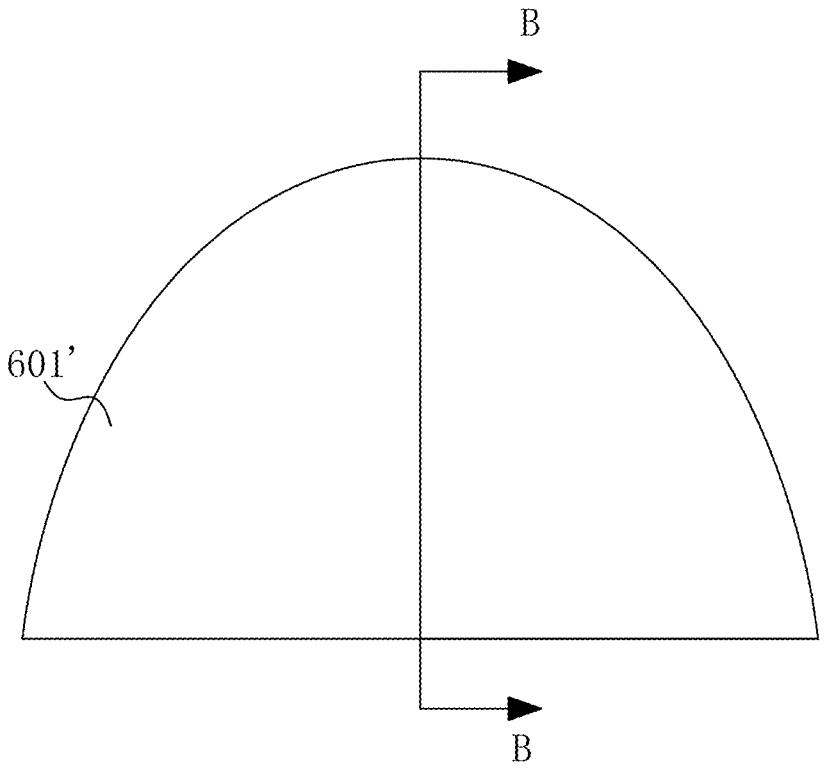
FIG. 8 is a schematic structural view of light stretching member of first embodiment.
Figure 9:
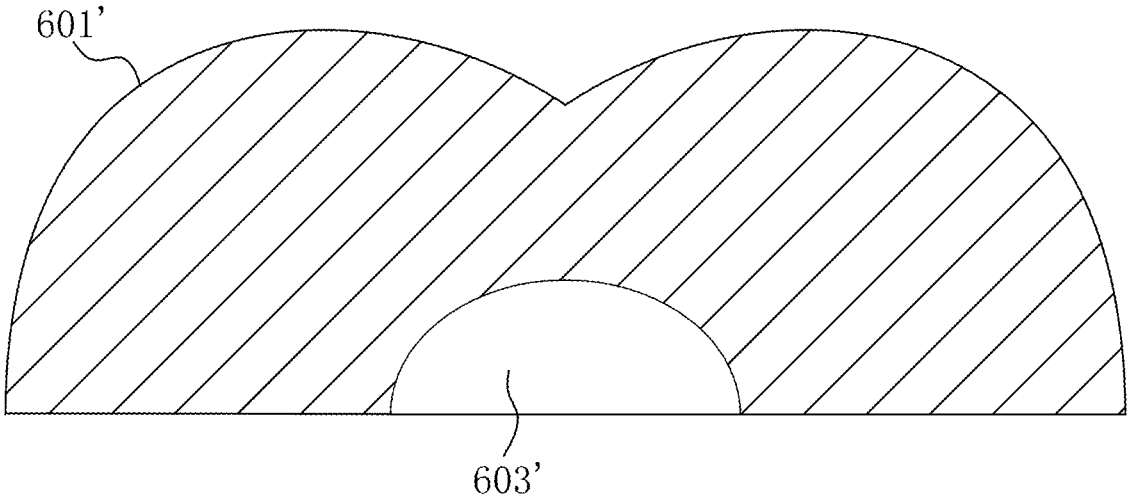
FIG. 9 is a schematic cross-sectional view in the B-B direction of FIG. 8.
Figure 10:
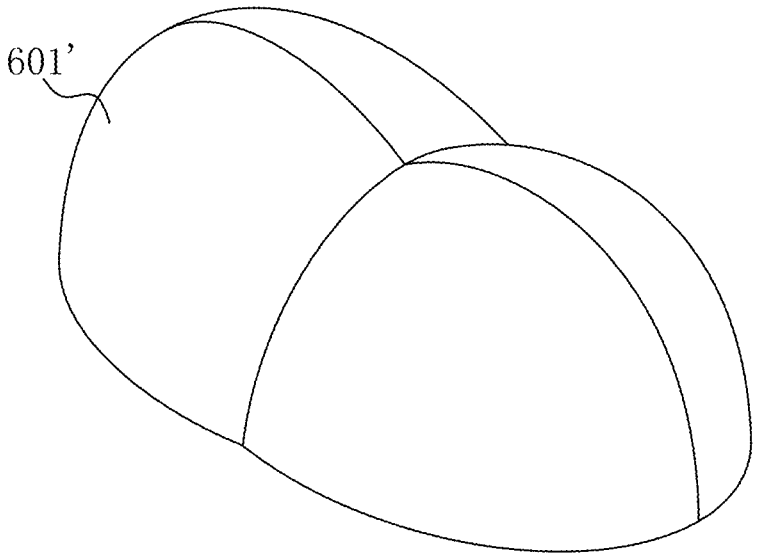
FIG. 10 is a perspective view showing the three-dimensional structure of light stretching member of the first embodiment at a viewing angle.
Figure 11:
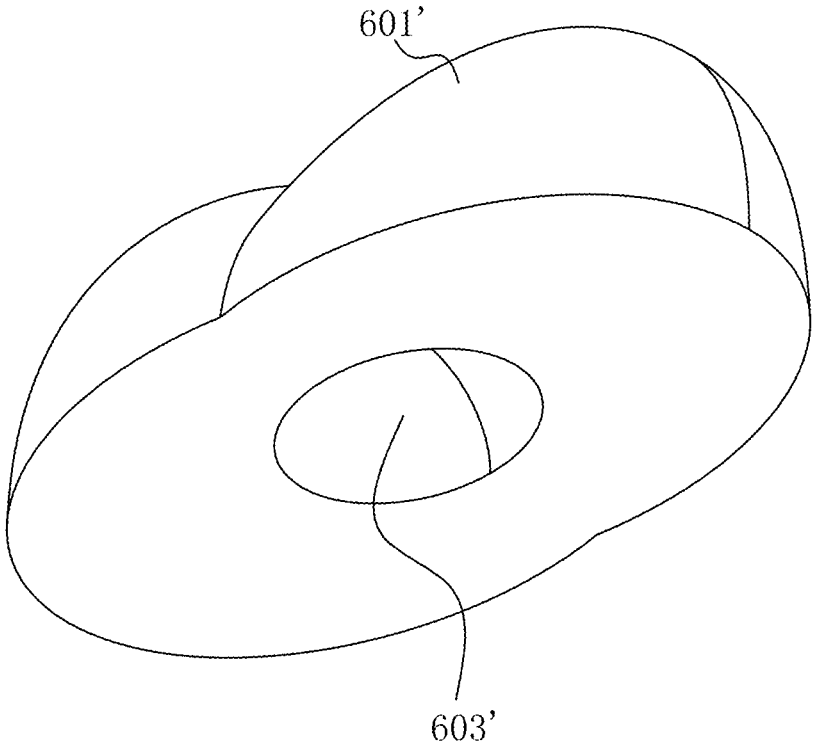
FIG. 11 is a perspective view showing the three-dimensional structure of light stretching member of the first embodiment at another viewing angle.
Figure 12:
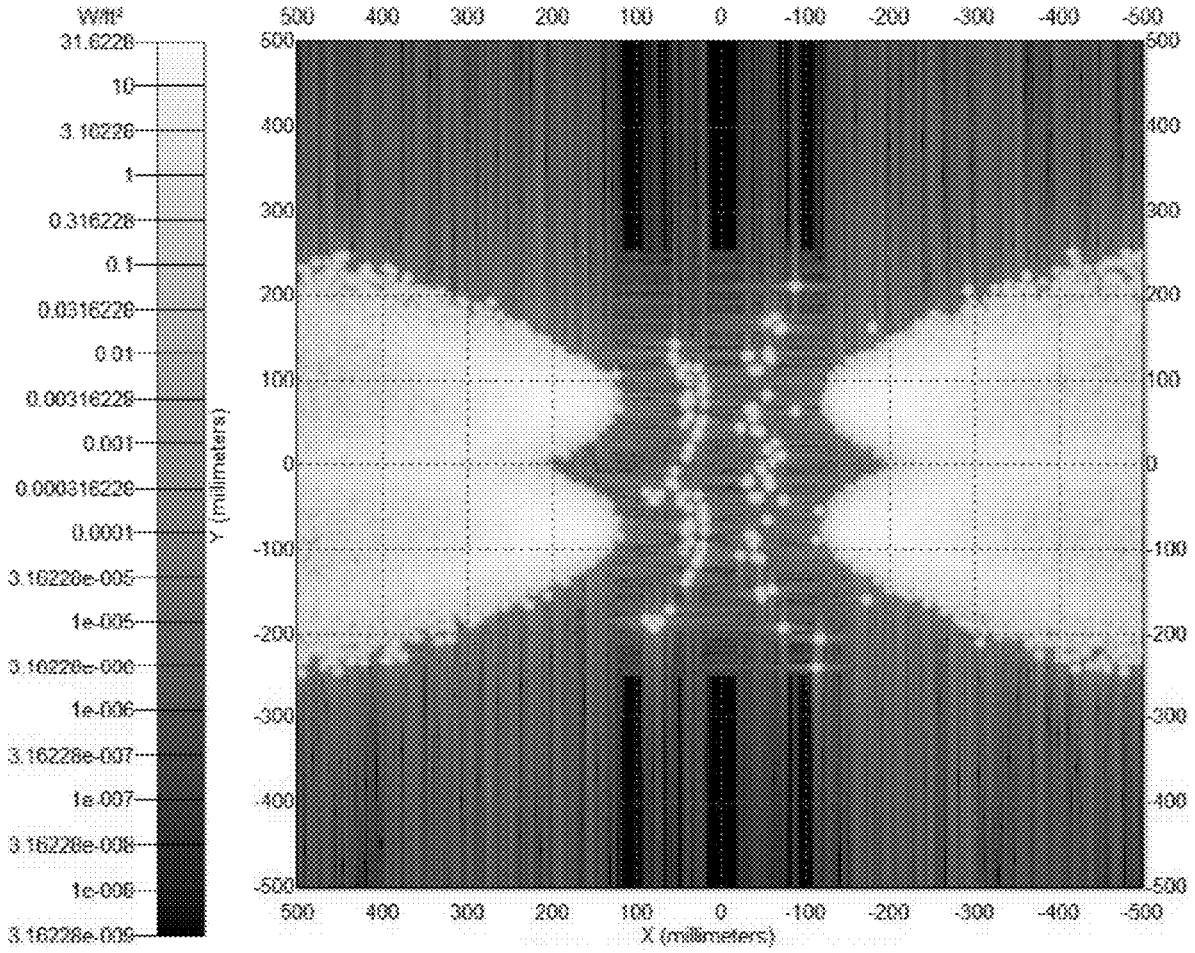
FIG. 12 is a view showing the distribution of the light intensity on the illumination surface of the strip light (light source in the light stretching member is not lit) used in showcase of the first embodiment.
Figure 13:
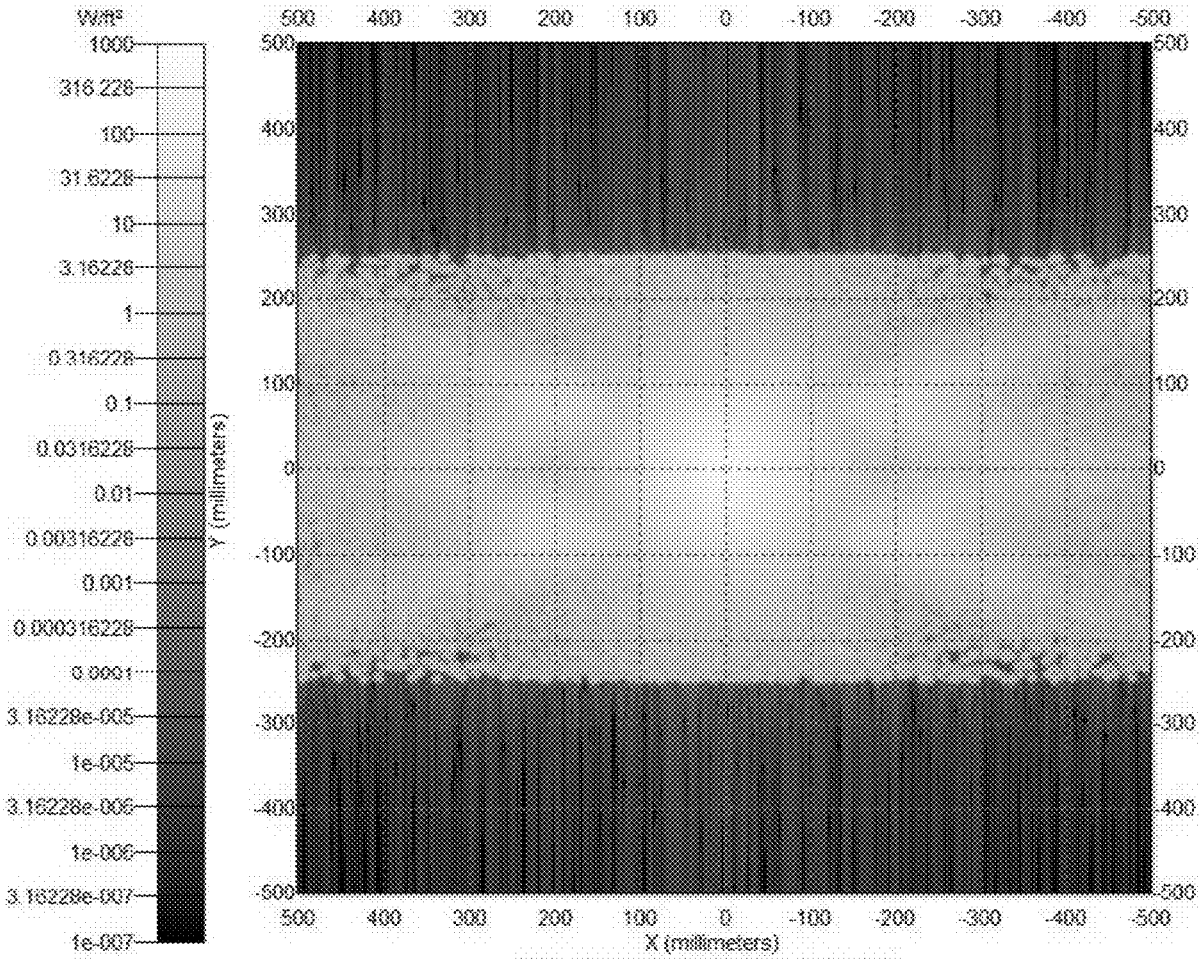
FIG. 13 is a view showing the distribution of light intensity on the illumination surface of the strip light (light source in the light stretching member is lit up) used in showcase of the first embodiment.
Figure 14:
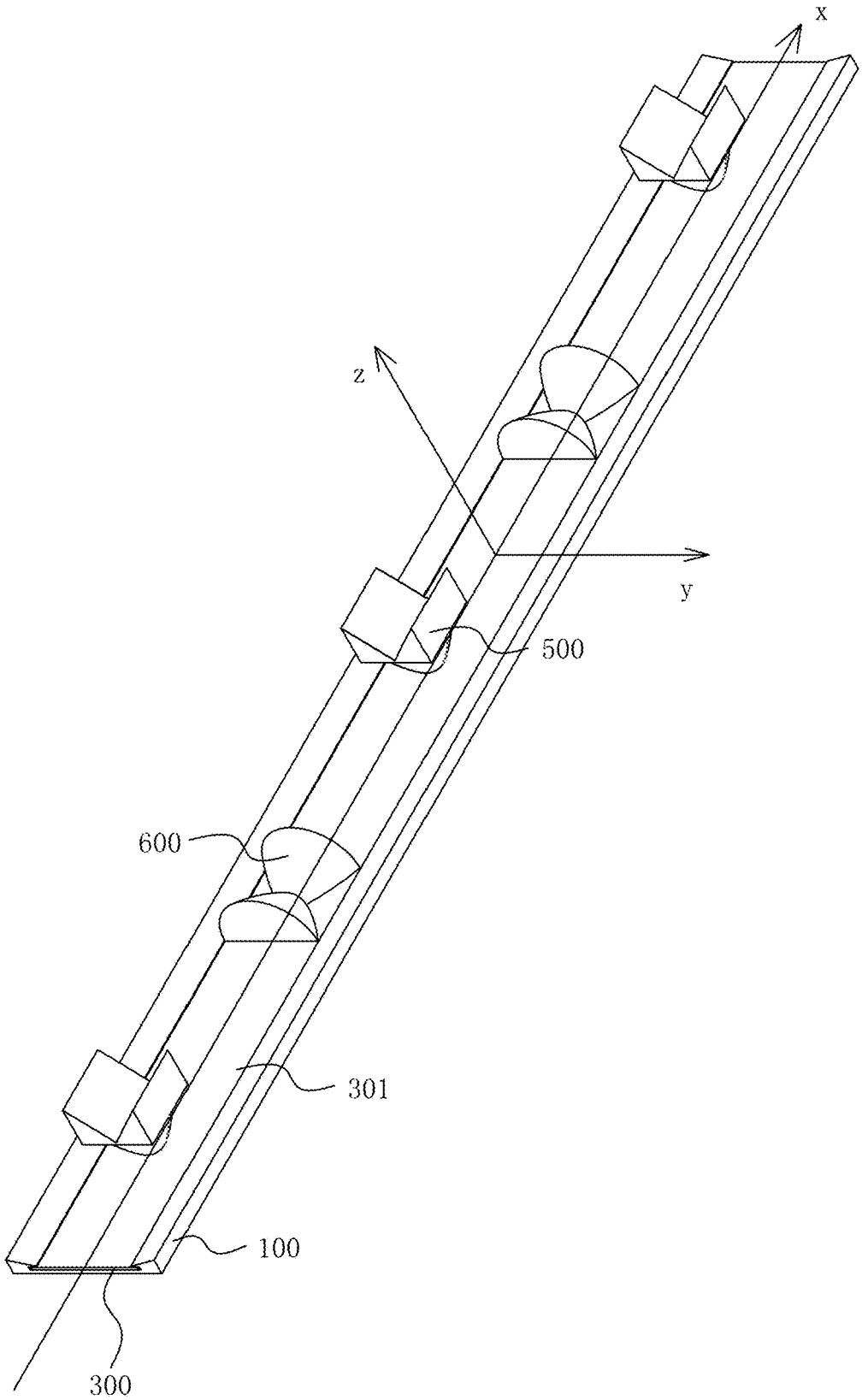
FIG. 14 is a schematic diagram of the three-dimensional structure of strip light used in showcase of the second embodiment.
Figure 15:
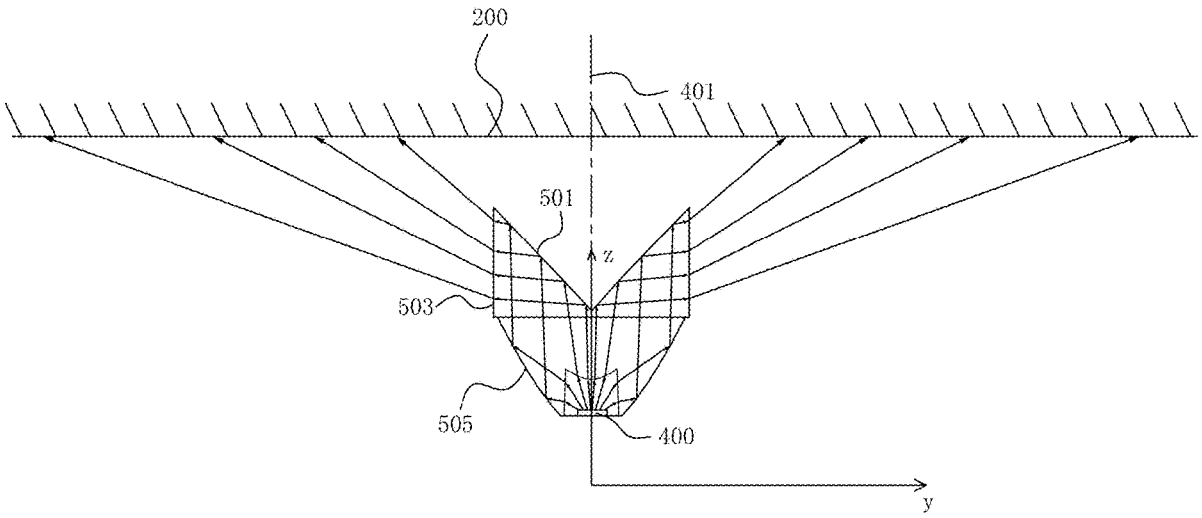
FIG. 15 is a light path diagram of a cross section of first light splitting member of the second embodiment in the longitudinal direction of the vertical lamp body.
Figure 16:
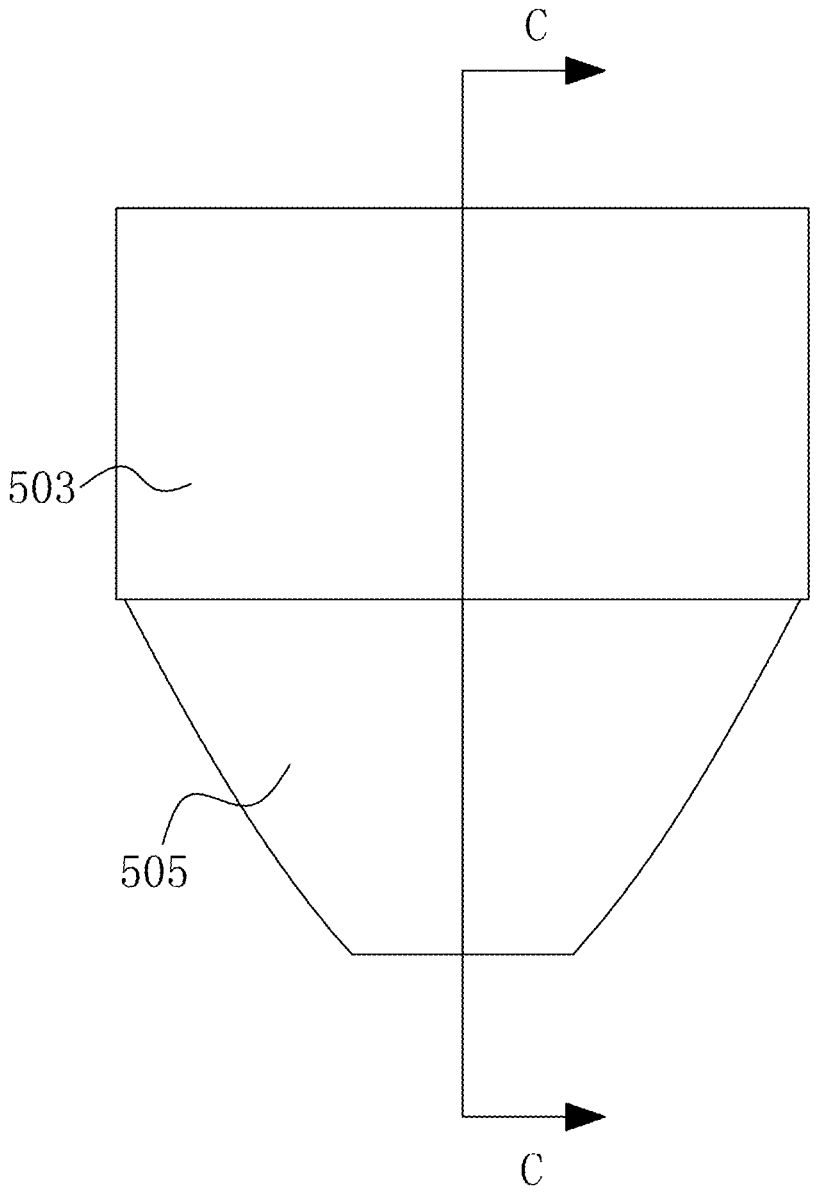
FIG. 16 is a schematic view showing the structure of first light splitting member of the second embodiment.
Figure 17:
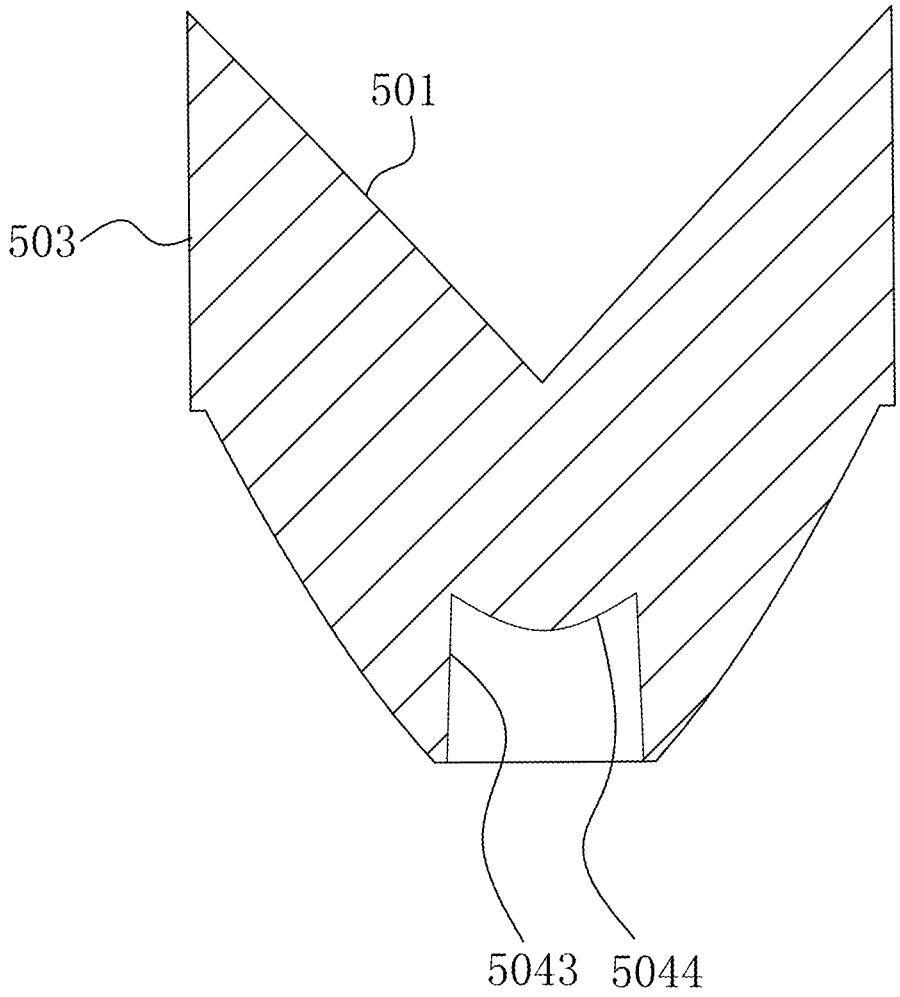
FIG. 17 is a cross-sectional view in the C-C direction of FIG. 16.
Figure 18:
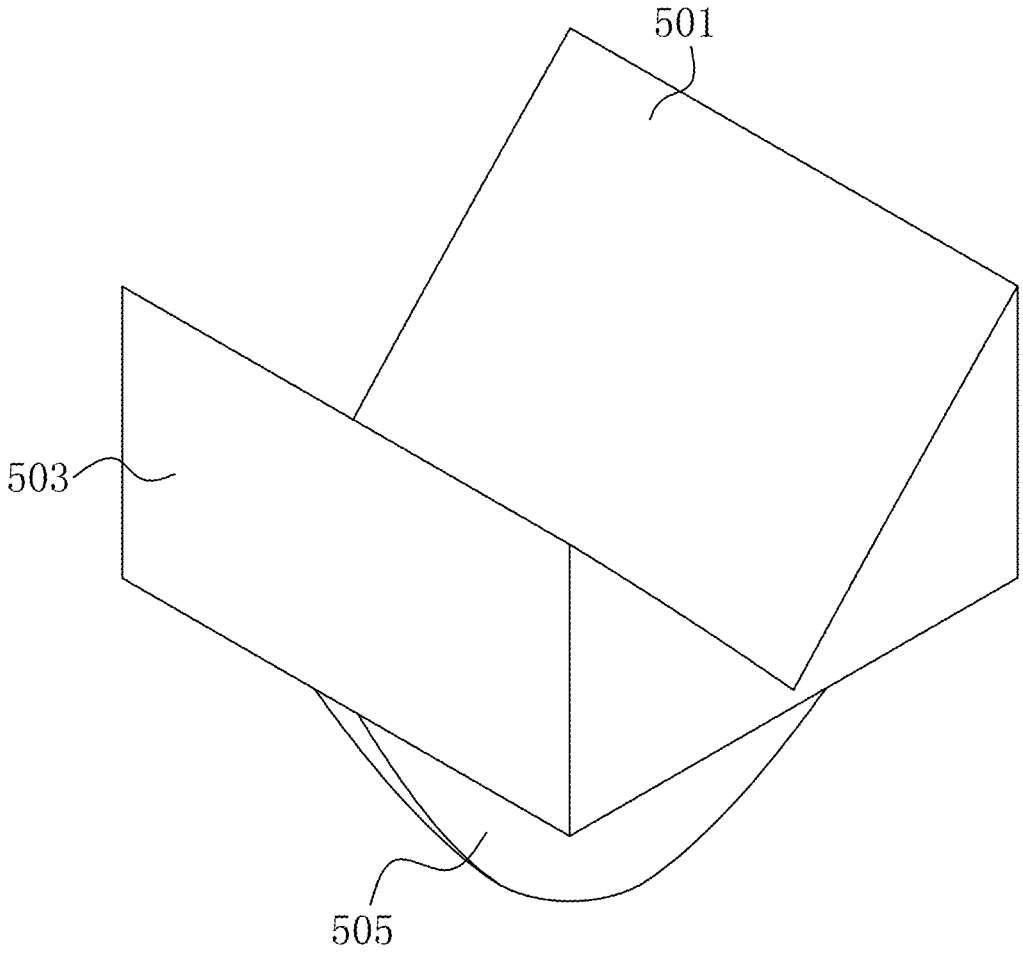
FIG. 18 is a schematic diagram of the three-dimensional structure of first light splitting member of the second embodiment at a viewing angle.
Figure 19:
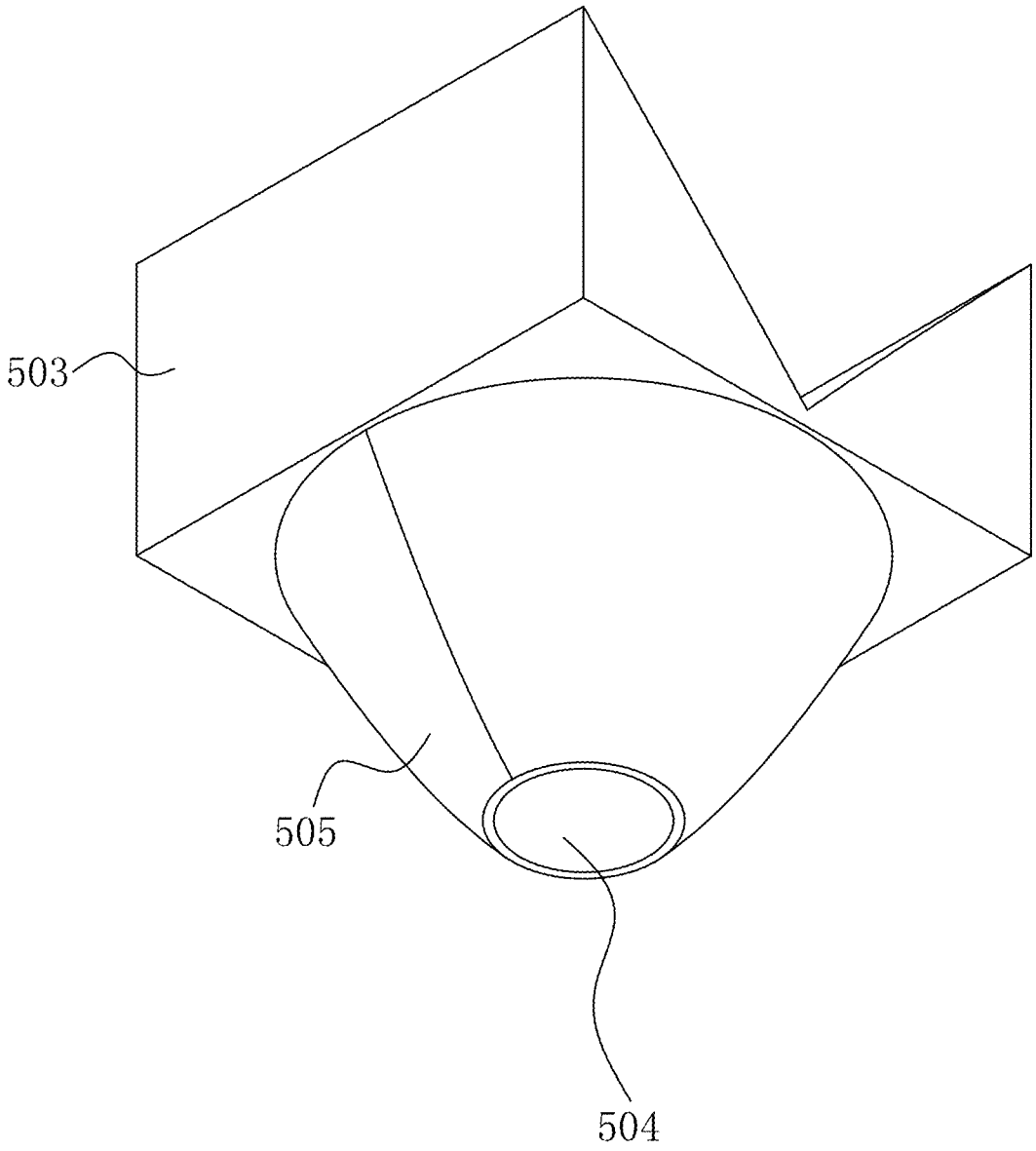
FIG. 19 is a schematic diagram of the three-dimensional structure of first light splitting member of the second embodiment at another viewing angle.
Figure 20:
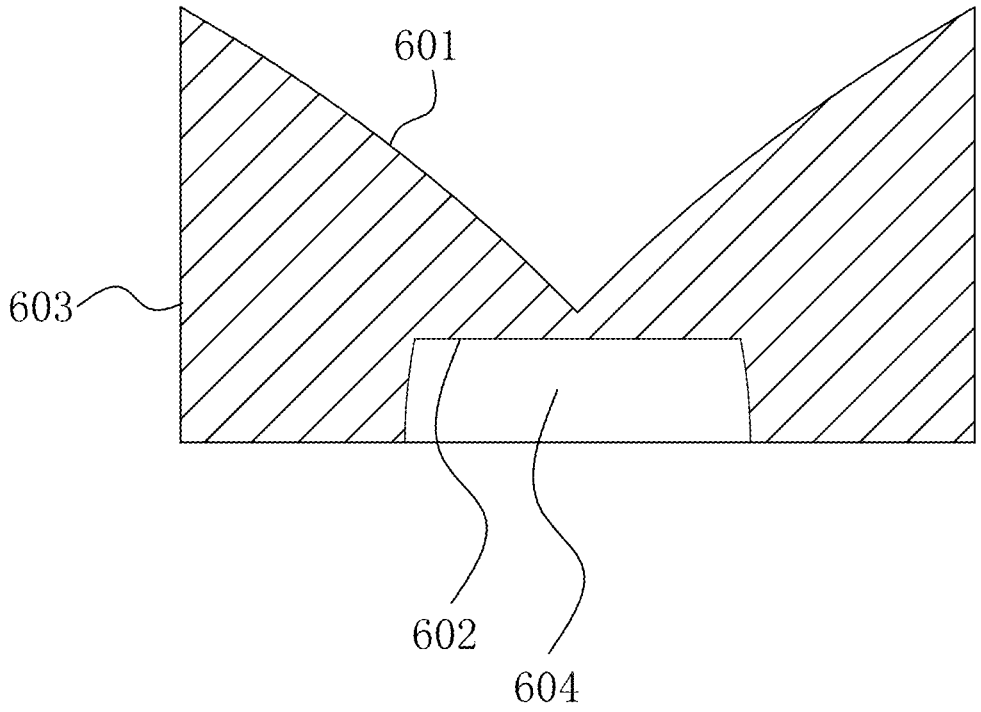
FIG. 20 is a sectional diagram of the second light splitting member of the second embodiment.
Figure 21:
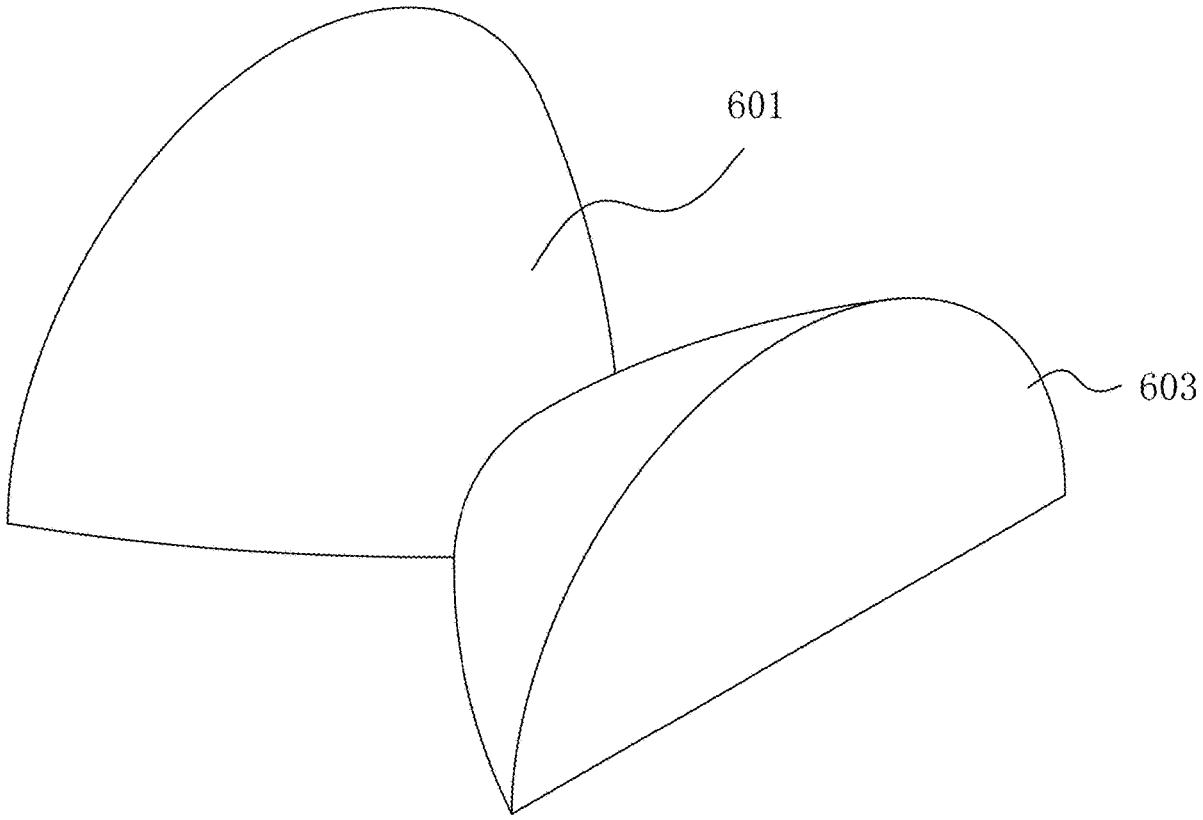
FIG. 21 is a schematic diagram of the three-dimensional structure of the second light splitting member in the second embodiment.
Figure 22:
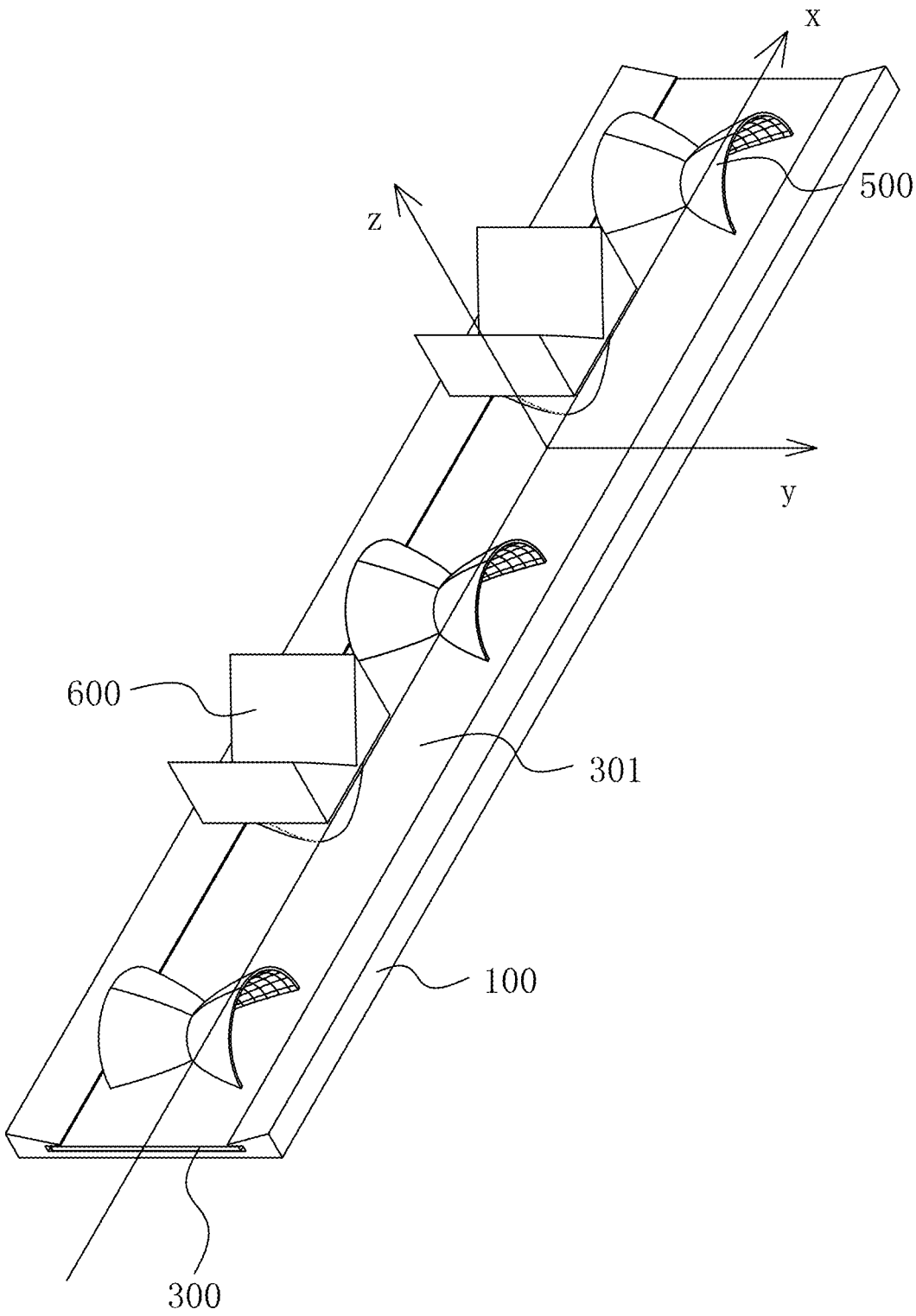
FIG. 22 is a schematic diagram of the three-dimensional structure of strip light used in showcase of the third embodiment.
Figure 23:
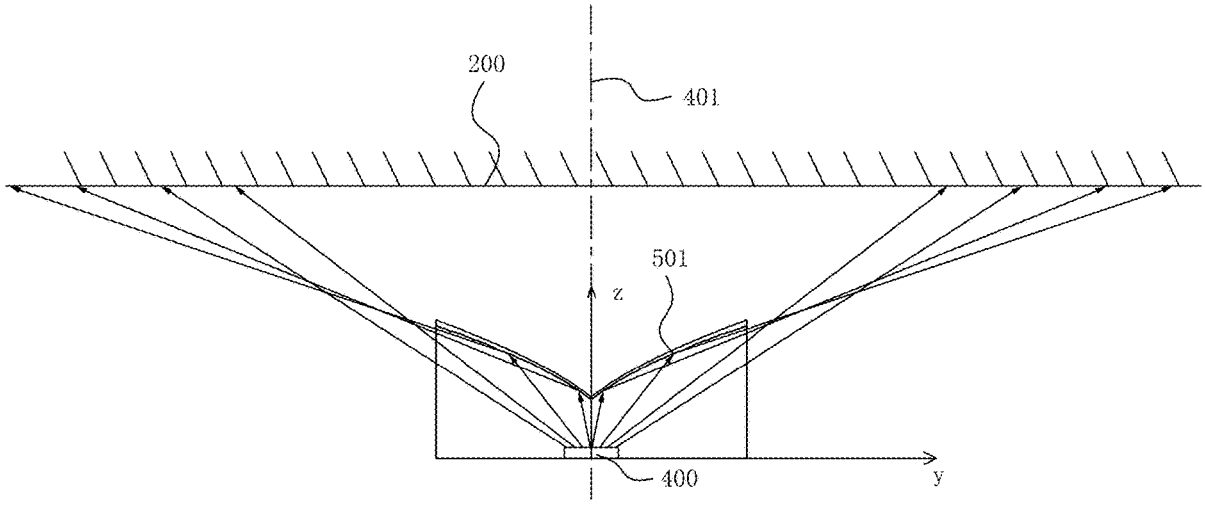
FIG. 23 is a light path diagram of a cross section of first light splitting member of the third embodiment in the longitudinal direction of the vertical lamp body.
Figure 24:
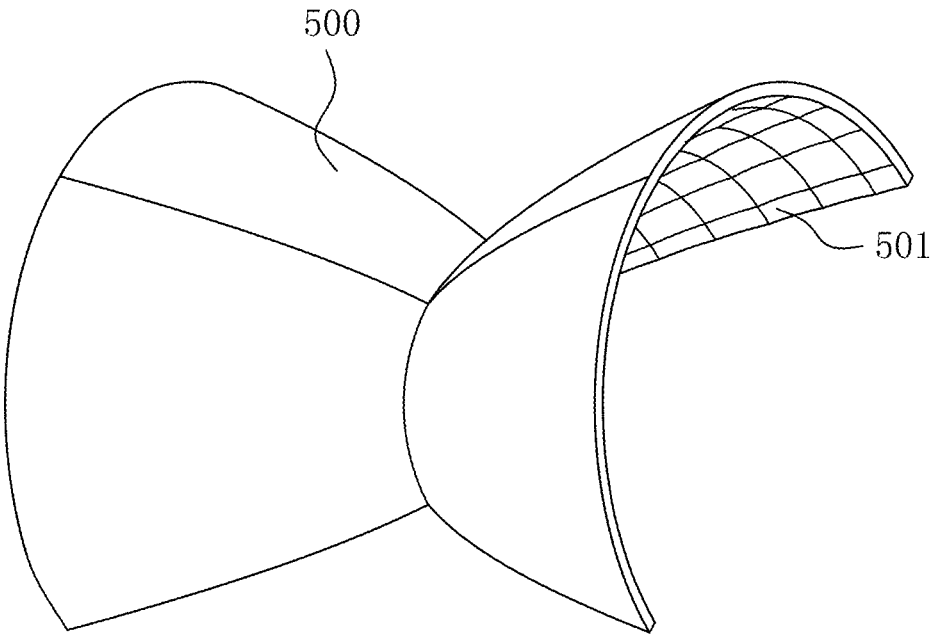
FIG. 24 is a schematic diagram of the three-dimensional structure of first light splitting member of the third embodiment.
Figure 25:
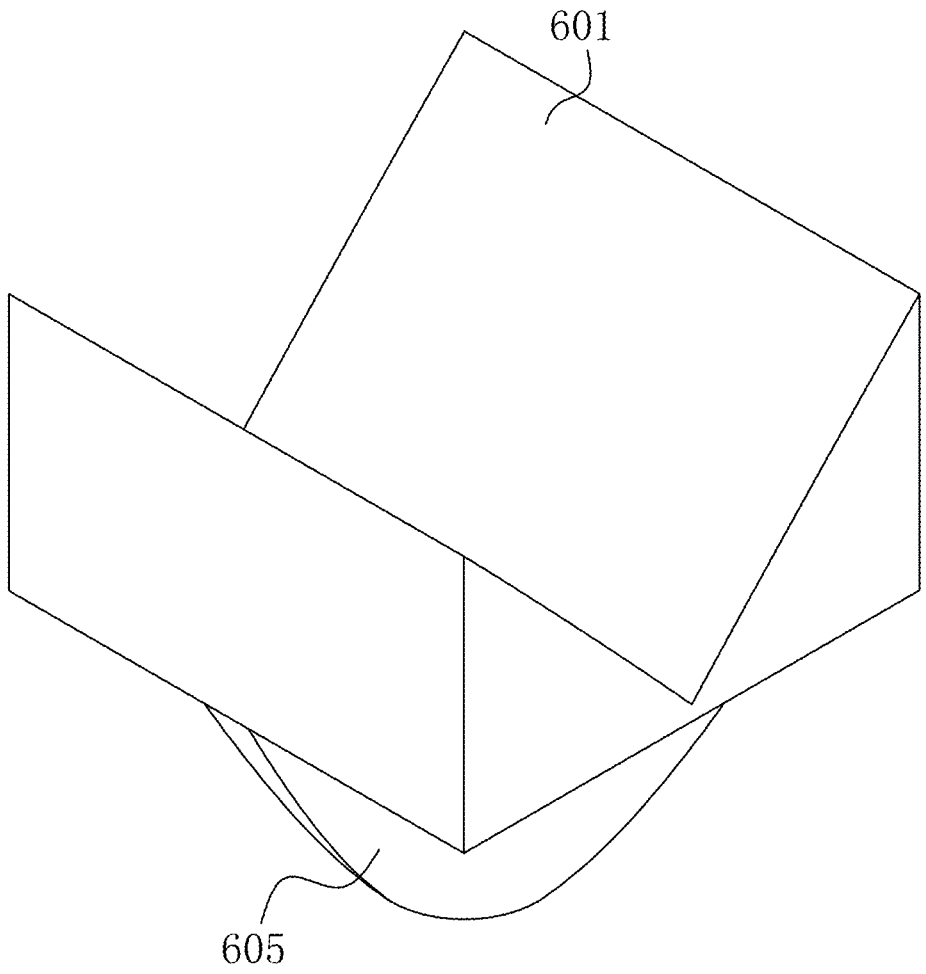
FIG. 25 is a schematic diagram of the three-dimensional structure of second light splitting member of the third embodiment.

To this end, in the present embodiment, the optical component comprises a light stretching member 600, and the light stretching member 600 is provided with at least one group, at least one of which is provided in each group, for the purpose of illuminating the dark area, each group of the light stretching member 600 is located between adjacent two groups of first light splitting members 500, each group of light stretching members 600 is used to illuminate the light of its corresponding light source 400 into the dark area, thereby making the overall illumination effect of the illumination surface 200 uniform. In order to achieve the above functions, the light stretching member 600 of the present embodiment is used for diffusing the light of the light source 400 along the length direction of the strip light holder and projecting it onto the illumination surface 200 directly in front of the first light splitting member 500 of the adjacent group, thereby eliminating dark areas and achieving uniform illumination, as shown in FIG. 8.

the first light splitting member 500 and the light stretching member 600 are arranged at a group interval and the number in each group can be set as needed. Embodiments are a group of one, and the first light splitting member 500 and/or the light stretching member 600 can also be two or more in one group.

In this embodiment, the length direction of the strip light holder 100 is the same as the length direction of the mounting frame (the mullion or the horizontal frame) and is defined as the x-axis, the width direction is perpendicular to the length direction and defined as the y-axis, and the z axis is perpendicular to the x-y plane. The optical axis 401 of the light source 400 is parallel to the z-axis, the longitudinal direction of the circuit board 300 is parallel to the x-axis, and the width direction of the circuit board 300 is parallel to the y-axis.

The splitting function of the first light splitting member 500 can be achieved by total reflection of the lens or by reflection of the reflective material. Specifically, in the embodiment, the first light splitting member 500 adopts light splitting lens, the first light splitting member 500 includes a first light splitting surface 501, which is total reflection surface, and the first light splitting member 500 further includes a first light incident surface 502 disposed in a light emitting direction of the light source 400 and a first light emitting surface 503 distributed on two sides of the optical axis of the light source 400. The first light splitting surface 501 is located above the first light incident surface 502 along the light emitting direction of the light source 400. The first light emitting surface 503 is located outside of first light splitting surface 501 in the same side.

In order to improve the light efficiency and make full use of the light from the light source 400. In this embodiment, the bottom surface of the first light splitting member 500 is provided with a first counter bore 504 for accommodating the light source 400, and the inner wall of the first counter bore 504 forms first light incident surface 502.

In order to improve the light efficiency, it is necessary to focus the light emitted from the light source 400 in the longitudinal direction. Therefore, in the embodiment, the first light splitting surface 501 is curved focusing surface along the length direction of the strip light holder 100. In order to make the light uniform, the concentrating surface is symmetrically disposed with respect to the optical axis 401.

The first counter bore 504 includes arch top surface 5041 extending in the width direction of the strip light holder 100 and side surface 5042 disposed on both sides of the longitudinal direction of the arch top surface 5041. Most of the light passing through the arch top surface 5041 is refracted to the first light splitting surface 501, and most of the light passing through the side surface 5042 is refracted to the first light emitting surface 503. The structure of the first counter bore 504 can concentrate the light first, thereby improving the light efficiency.

The first light emitting surface 503 can further refract the totally reflected light. In this embodiment, the first light emitting surface 503 is perpendicular to the light source mounting surface 301.

The first light splitting member 500 of this embodiment can achieve large angle splitting, and the illumination on the illumination surface 200 is uniform. The disadvantage is that there is almost no light directly under the first light splitting member 500, and the position of the illumination surface 200 facing the first light splitting member 500 (right in front of the first light splitting member 500 and in the optical axis direction) has a dark area. When continuously arranged, a strip-shaped dark area is formed directly in front of the lamp body.

In order to eliminate the dark region described above, the light stretching member 600 uses a light stretching lens, the light stretching member 600 comprises a second light incident surface 602' and two second light stretching surface 601' distributed on both sides of the optical axis 401 of the light source 400. The second light stretching surface 601' diffuses light outward along the length direction of the strip light holder 100 and projects the light onto the illumination surface 200 directly in front of the adjacent first light splitting member 500. The two second light stretching surfaces 601' are interactive and concave at the optical axis 401. In order to make the light emitted uniformly, the second light stretching surface 601' on both sides are curved surfaces.

In order to improve the light efficiency, the second light stretching surface 601' focus the light along the width direction of the strip light holder 100. The second light stretching surface 601' is a curved surface.

In order to improve the light efficiency, the bottom surface of the light stretching member 600 is provided with a third counter bore 603' for accommodating the light source 400, and the inner wall of the third counter bore 603' forms the second light incident surface 602'. For the convenience of manufacturing, the third counter bore 603' is a focusing curved surface in the width direction and the length direction of the strip light holder 100.

through the intersection arrangement of the first light splitting member 500 and the light stretching member 600 in the embodiment, the first light splitting member 500 enables the single row light source 400 to achieve large angle splitting, and the light stretching member 600 fills the unevenness of the dark area. Thereby, the illumination surface 200 having a large and uniform irradiation range is obtained as a whole.

Embodiment 2

As shown in FIG. 14 to 21, the strip light used in the showcase of the present embodiment has the same configuration as that of the first embodiment except for the structures of the first light splitting member 500 and the light stretching member 600.

In this embodiment, the first light splitting member 500 further includes a first collimating surface 505 disposed between the first light incident surface 502 and the first light emitting surface 503 to totally reflect the large-angle light of the light source to the first light splitting surface 501. The large-angle light is relative to small-angle light. The optical axis of the light source and its vicinity are small-angle light, and the light outside the small-angle light is large-angle light.

In the first embodiment, all the light is focused in the longitudinal direction, and the light is split in the width direction, and both are realized by the first light splitting surface, so that a large amount of light is refracted without light splitting, but in this embodiment, in order to improve the light efficiency, the light is collimated first, and then most of the light is projected onto the first light splitting surface 501 for splitting. Preferably, the first collimating surface 505 is a rotation surface with the optical axis 401 as a central axis. The setting of the rotation surface can totally reflect the light of the light source to the first light splitting surface 501 as much as possible, thereby improving the light efficiency.

Since the light is collimated first, in the embodiment, the first light splitting surface 501 is a flat surface extending in the longitudinal direction of the strip light holder 100.

In order to further improve the light efficiency, in the embodiment, the first counter bore 504 includes a cylindrical surface 5043 extending in a direction perpendicular to the light source mounting surface 301 and a dome surface 5044 for focusing light. The light passing through the dome surface 5044 is mostly refracted to the first light splitting surface 501, and the light passing through the cylindrical surface 5043 is mostly refracted to the first collimating surface 505. The first light emitting surface 503 is perpendicular to the light source mounting surface 301 for ease of manufacture.

In this embodiment, the light stretching member 600 is perpendicular to the first light splitting member 500 in the light splitting direction and includes two second light splitting surfaces distributed on two sides of the optical axis of the light source 400, and the second light splitting surface guides the light of the light source 400 at the optical axis 401 and its vicinity outward in the longitudinal direction of the strip light holder 100 and projected onto the illumination surface 200 directly in front of first light splitting member 500 in the adjacent groups.

It can be seen that the light stretching member 600 in the present embodiment has the same structure as the first light splitting member 500 in the first embodiment, but the light splitting directions are different, and the light splitting directions are perpendicular to each other, thus, the dark area generated by the first light splitting member 500 can be fill supplementary lighting.

Specifically, the light stretching member 600 adopts light splitting lens, the light stretching member 600 comprises second light splitting surface 601, which is total reflection surface, and the light stretching member 600 further comprises a second light incident surface 602 disposed in a light emitting direction of the light source 400 and two second light emitting surface 603 distributed on both sides of the optical axis of the light source 400, the second light splitting surface 601 is located above the second light incident surface 602 along the light emitting direction of the light source 400, and the second light emitting surface 603 is located outside of the second light splitting surface 601 on the same side.

In order to improve the light efficiency, the bottom surface of the light stretching member is provided with a second counter bore 604 for accommodating the light source 400, and the inner wall of the second counter bore 604 forms the second light incident surface 602. In order to improve the uniformity of the illumination and improve the light effect, the second light splitting surface 601 is a curved focusing surface along the longitudinal direction of the strip light holder 100.

Embodiment 3

As shown in FIG. 22 to 25, the strip light used in the showcase of the present embodiment has the same configuration as that of the first embodiment except for the structures of the first light splitting member 500 and the light stretching member 600.

In the embodiment, the first light splitting member 500 uses a reflector with the first light splitting surface 501 as a reflecting surface. The light of the light source 400 is reflected by the first light splitting surface 501 of the reflector, and is then illuminated onto the illumination surface. In the embodiment, the first light splitting surface 501 of the reflector is provided with a moiré structure.

In this embodiment, the light stretching member 600 further includes a second collimating surface 605 disposed between the second light incident surface 602 and the second light emitting surface 603 fully reflected the large angle light of the light source to the second light splitting surface 601. The structure of the light stretching member in this embodiment is the same as that of the first light splitting member 500 in the second embodiment, and the splitting directions are perpendicular to each other. The structural picture refers to the first light splitting member 500 in the second embodiment.

The second collimating surface 605 is a rotation surface with the optical axis 401 as a central axis. The setting of the rotation surface can totally reflect the light of the light source as much as possible to the second light splitting surface 601, thereby improving the light efficiency. Since the light is collimated first, the second light splitting surface 601 of the present embodiment is a flat surface extending in the width direction of the strip light holder 100.

The light stretching member can also be a reflector having a second light splitting surface 601 as a reflecting surface. In this case, the light splitting direction is perpendicular to the light splitting direction of the reflector of the embodiment.

In summary, the first light splitting member 500 of the present invention can adopt any one of the embodiments 1, 2 and 3. The light stretching member 600 can also adopt any one of the embodiments 1, 2 and 3 or a reflective cup. In the form of the above, the first light splitting member 500 and the light stretching member 600 can be combined in any way to achieve a large angle uniform illumination without dark areas.

Embodiment 4

Figure 26:
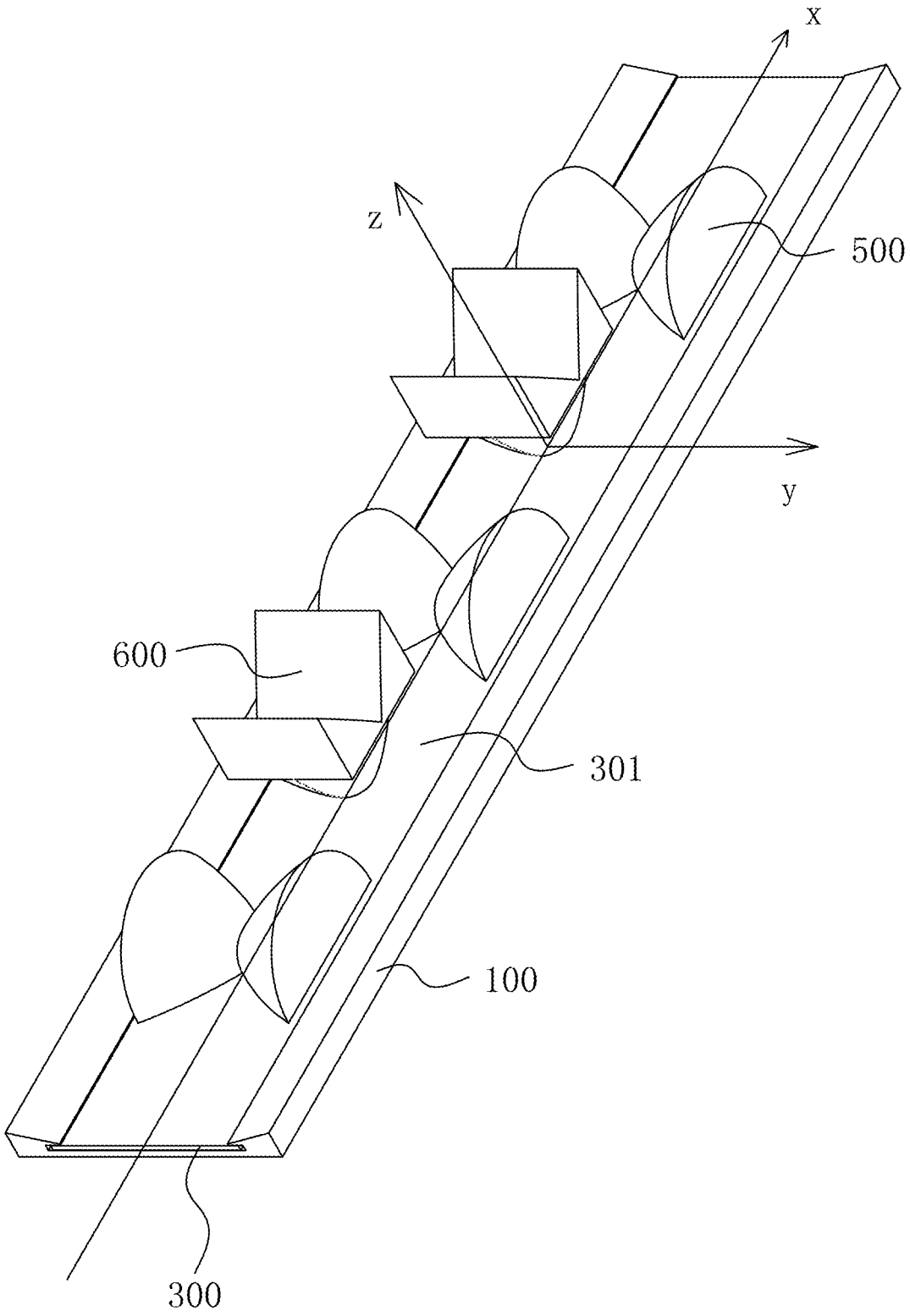
FIG. 26 is a schematic diagram of the three-dimensional structure of strip light used in showcase of the fourth embodiment.

As shown in FIG. 26, the strip light used in showcase of the present embodiment, the first light splitting member 500 is the same as that of the first embodiment, and the light stretching member 600 is the same as that of the third embodiment.

Embodiment 5

Figure 27:
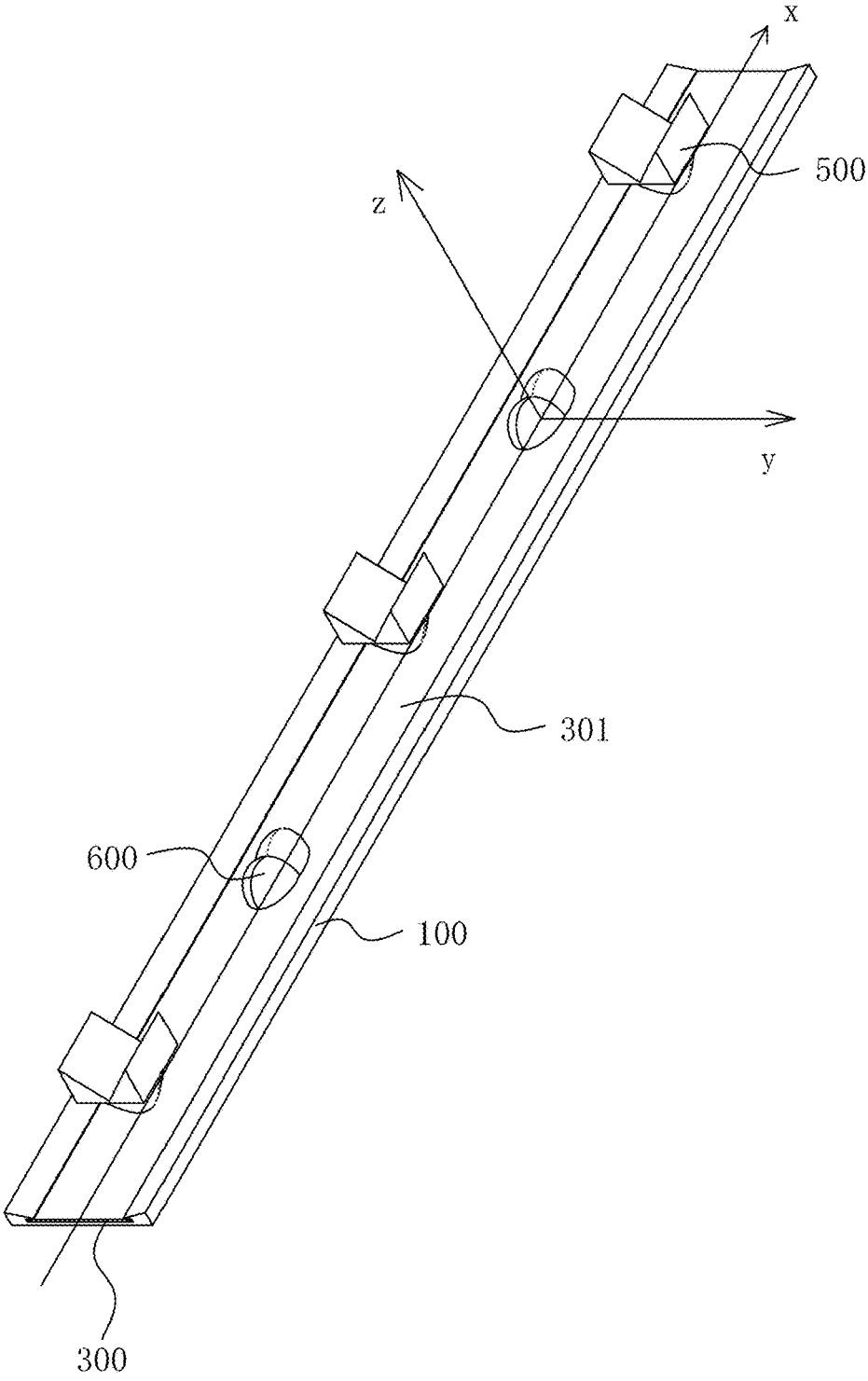
FIG. 27 is a schematic diagram of the three-dimensional structure of strip light used in showcase of the fifth embodiment.

As shown in FIG. 27, the strip light used in showcase of the present embodiment, the first light splitting member 500 is the same as that of the second embodiment, and the light stretching member 600 is the same as that of the first embodiment.

Embodiment 6

Figure 28:
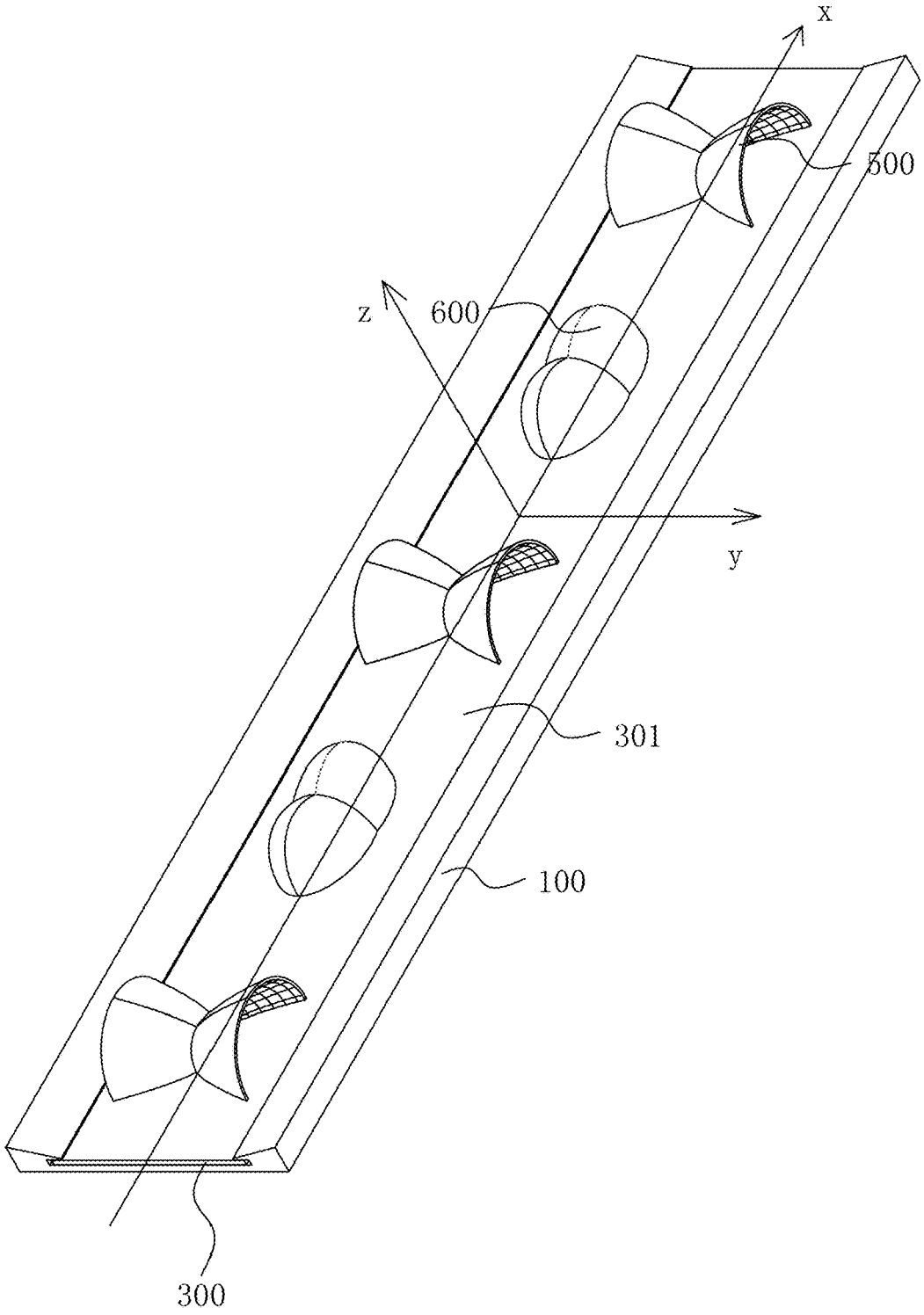
FIG. 28 is a schematic diagram of the three-dimensional structure of strip light used in showcase of the sixth embodiment.

As shown in FIG. 28, the strip light used in showcase of the present embodiment, the first light splitting member 500 is the same as that of the third embodiment, and the light stretching member 600 is the same as that of the first embodiment.

Embodiment 7

Figure 29:
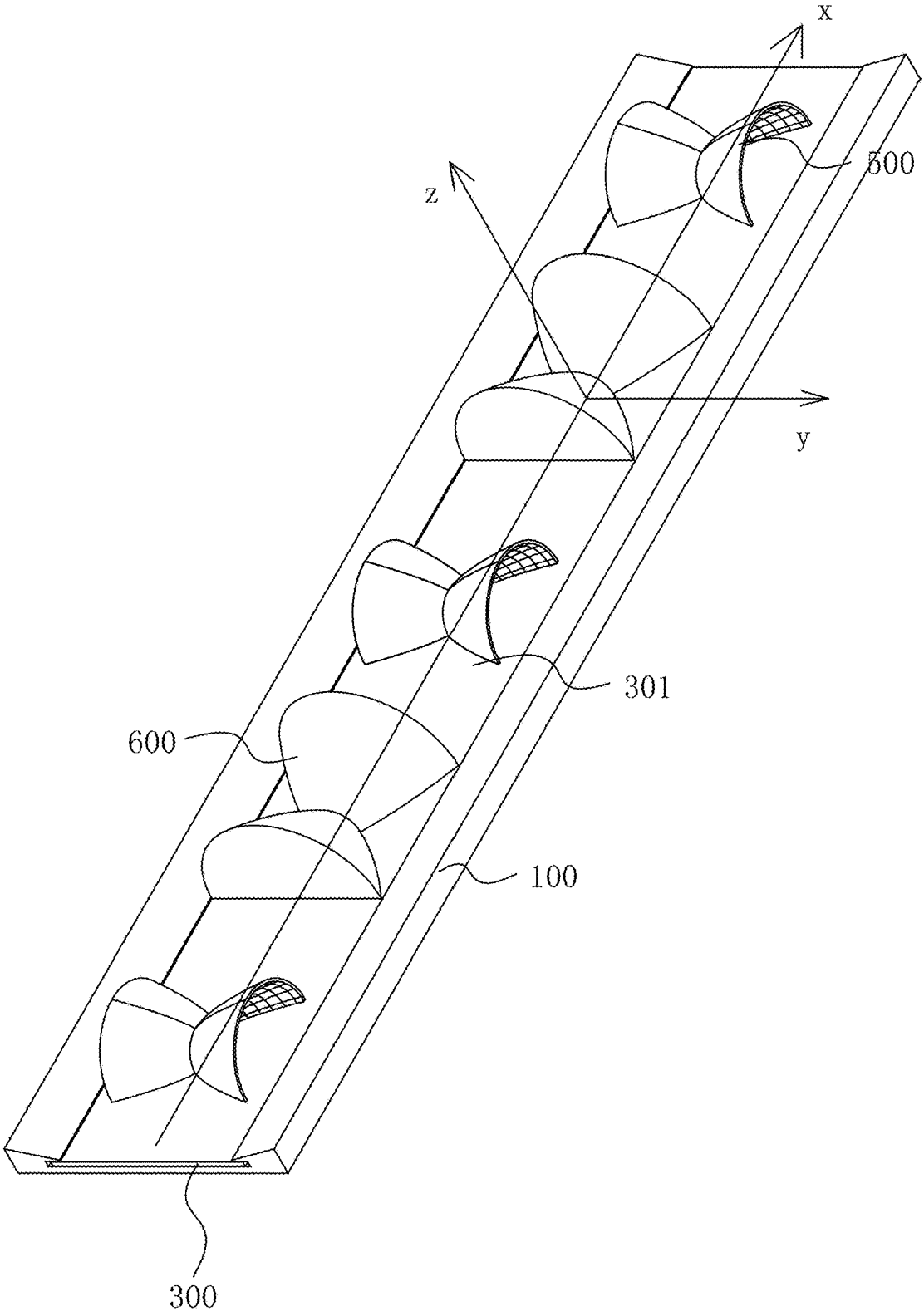
FIG. 29 is a schematic diagram of the three-dimensional structure of strip light used in showcase of the seventh embodiment.

As shown in FIG. 29, the strip light used in showcase of the present embodiment, the first light splitting member 500 is the same as that of the third embodiment, and the light stretching member 600 is the same as that of the second embodiment.

Embodiment 8

Figure 30:
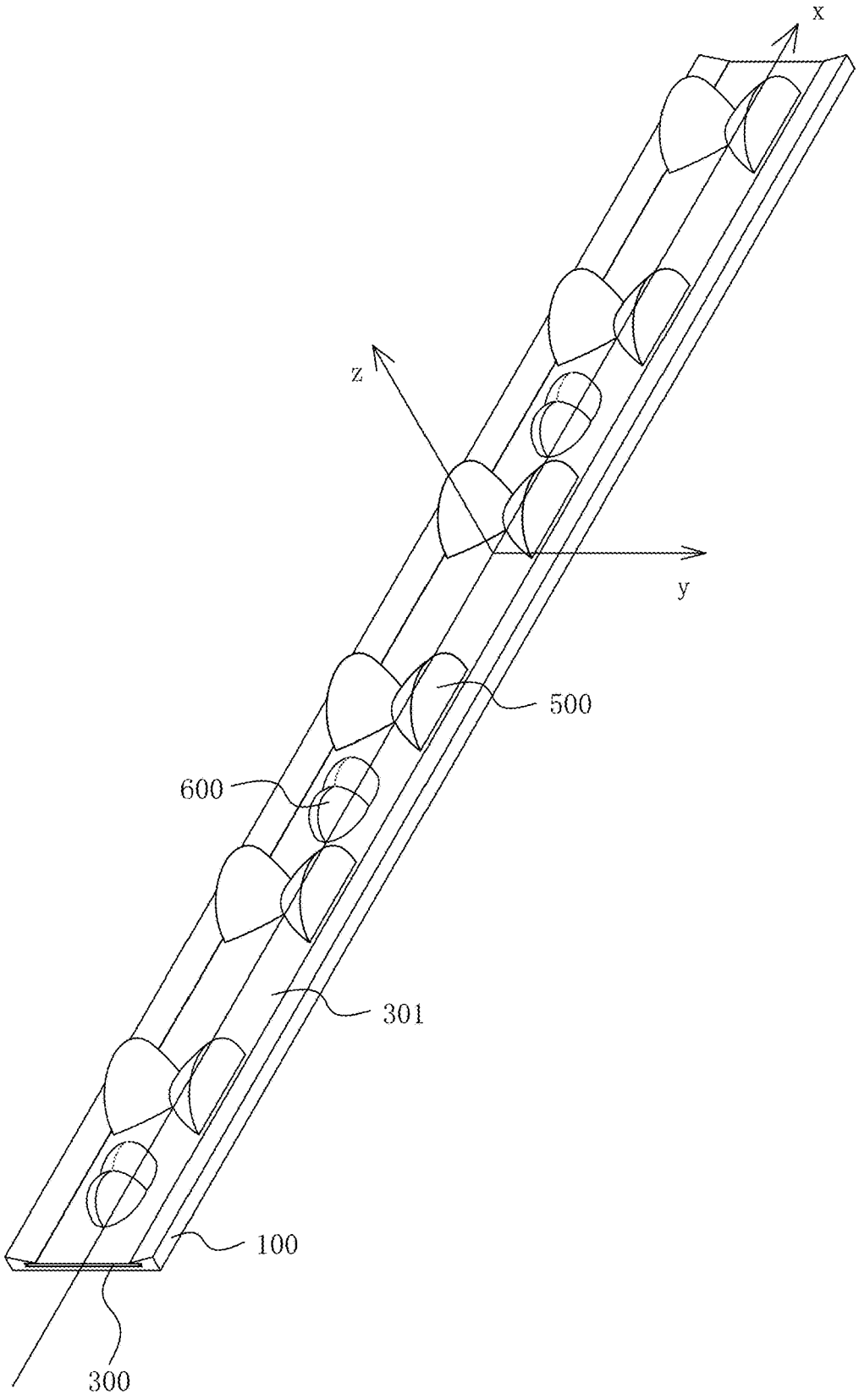
FIG. 30 is a schematic diagram of the three-dimensional structure of strip light used in showcase of the eighth embodiment.

As shown in FIG. 30, the strip light used in showcase of the present embodiment, the number of each of the first light splitting members 500 is different from that of the first embodiment, and the rest of the structure is the same as that of the first embodiment.

In order to achieve illumination on both sides in the width direction of the strip light, the optical component includes a first light splitting member 500 and a light stretching member 600. The first light splitting member 500 is provided with at least two groups, at least one of which is disposed in each group. The purpose of the first light splitting member 500 is to achieve large angle illumination, and at least two groups can be set to achieve illumination of a certain length area in the longitudinal direction of the lamp body (the mullion or the length direction of the horizontal frame). In each group, one or more can be used, and the number of each group can be the same or different, and the same number of light sources 400 are correspondingly arranged, which is generally related to the length of the illumination. The light stretching member 600 is provided with at least one group, at least one of which is disposed in each group, the purpose of which is to illuminate the dark area mentioned above, therefore, each group is located between first light splitting members 500 in the adjacent two groups, each group of the light stretching member 600 is used to illuminate the dark area with the light of the corresponding light source 400, so that the overall illumination effect of the illumination surface 200 is uniform, and each group can be one or more, and the number of each group can be the same or different.

In this embodiment, each group of first light splitting members 500 is provided with two, with the same structure as that of embodiment 1, and each group of light stretching members 600 is provided with one, with the same structure as that of embodiment 1.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A strip light used in showcase, comprising:

a strip light holder (100), disposed opposite to an illumination surface (200);

a circuit board (300), disposed on the strip light holder (100), provided with a light source mounting surface (301) toward the illumination surface (200);

at least three light sources (400), disposed spaced along a lengthwise direction of the strip light holder (100) on the light source mounting surface (301), and an optical axis (401) of the light source are perpendicular to the circuit board (300);

at least three optical components, respectively disposed corresponding to each of the light sources (400);

the optical components comprise:

at least two groups of first light splitting members (500), at least one first light splitting member (500) is provided in each group, and including two first light splitting surfaces (501) distributed on two sides of the optical axis of the light source (400); the first light splitting surface (501) directs light of the light source (400) at the optical axis (401) and its vicinity outward along the width direction of the strip light holder (100) and projects the light to a distal end of the illumination surface (200);

at least one group of light stretching members (600), at least one light stretching member (600) is provided in each group, each group being located between two adjacent groups of the first light splitting members (500), and used for diffusing the light of the light source (400) along the length direction of the strip light holder and projecting the light onto the illumination surface (200) directly in front of the first light splitting member (500) of the adjacent group of light stretching members (600).

2. The strip light used in showcase as claimed in claim 1, wherein the first light splitting member (500) comprises light splitting lens, the first light splitting member (500) includes a first light splitting surface (501), which is a total reflection surface; the first light splitting member (500) further includes a first light incident surface (502) disposed in a light emitting direction of the light source (400) and a first light emitting surface (503) distributed on the two sides of the optical axis of the light source (400); the first light splitting surface (501) is located above the first light incident surface (502) along the light emitting direction of the light source (400), and the first light emitting surface (503) is located outside of the first light splitting surface (501).

3. The strip light used in showcase as claimed in claim 2, wherein the bottom surface of the first light splitting member (500) is provided with a first counter bore (504) for accommodating the light source (400), and the inner wall of the first counter bore (504) forms the first light incident surface (502).

4. The strip light used in showcase as claimed in claim 2, wherein the first light splitting surface (501) is a curved focusing surface along the lengthwise direction of the strip light holder (100).

5. The strip light used in showcase as claimed in claim 3, wherein the first counter bore (504) includes an arch top surface (5041) and a side surface (5042) extending in a widthwise direction of the strip light holder (100) disposed on both sides of a longitudinal direction of the arch top surface (5041), and most of the light passing through the arch top surface (5041) is refracted to the first light splitting surface (501), and most of the light passing through the side surface (5042) is refracted to the first light emitting surface (503).

6. The strip light used in showcase as claimed in claim 2, wherein the first light emitting surface (503) is perpendicular to the light source mounting surface (301).

7. The strip light used in showcase as claimed in claim 2, wherein the first light splitting member (500) further includes a first collimating surface (505) disposed between the first light incident surface (502) and the first light emitting surface (503) to totally reflect large-angle light of the light source to the first light splitting surface (501).

8. The strip light used in showcase as claimed in claim 7, wherein the first collimating surface (505) is a rotation surface with the optical axis (401) as a central axis.

9. The strip light used in showcase as claimed in claim 7, wherein the first counter bore (504) includes a cylindrical surface (5043) extending in a direction perpendicular to the light source mounting surface (301) and a dome surface (5044) for focusing light, and the light passing through the dome surface (5044) is refracted to the first light splitting surface (501), and the light passing through the cylindrical surface (5043) is mostly refracted to the first collimating surface (505).

10. The strip light used in showcase as claimed in claim 2, wherein the first light emitting surface (503) is perpendicular to the light source mounting surface (301).

11. The strip light used in showcase as claimed in claim 1, wherein the light stretching member (600) is perpendicular to the first light splitting member (500) in the light splitting direction and includes two second light splitting surfaces (601) distributed on two sides of the optical axis of the light source (400); the second light splitting surface (601) guides the light of the light source (400) at the optical axis (401) and its vicinity outward in the longitudinal direction of the strip light holder (100) and projects the light onto the illumination surface (200) directly in front of the first light splitting member (500).

12. The strip light used in showcase as claimed in claim 11, wherein the light stretching member (600) comprises a light stretching lens, the light stretching member (600) comprises a second light splitting surface (601), which is a total reflection surface, and the light stretching member (600) further comprises a second light incident surface (602) disposed in a light emitting direction of the light source (400) and two second light emitting surface (603) distributed on both sides of the optical axis of the light source (400), the second light splitting surface (601) is located above the second light incident surface (602) along the light emitting direction of the light source (400), and the second light emitting surface (603) is located outside of the second light splitting surface (601) on the same side.

13. The strip light used in showcase as claimed in claim 12, wherein a bottom surface of the light stretching member (600) is provided with a second counter bore (604) for accommodating the light source (400), and the inner wall of the second counter bore (604) forms the second light incident surface (602).

14. The strip light used in showcase as claimed in claim 13, wherein the second light splitting surface (601) is a curved focusing surface along the longitudinal direction of the strip light holder (100).

15. The strip light used in showcase as claimed in claim 13, wherein the light stretching member (600) further includes a second collimating surface (605) disposed between the second light incident surface (602) and the second light emitting surface (603) fully reflecting large angle light of the light source to the second light splitting surface (601).

16. The strip light used in showcase as claimed in claim 15, wherein the second collimating surface (605) is a rotation surface with the optical axis (401) as a central axis.

17. The strip light used in showcase as claimed in claim 1, wherein the light stretching member (600) uses a light stretching lens, the light stretching member (600) comprises a second light incident surface (602') and two second light stretching surfaces (601') distributed on both sides of the optical axis (401) of the light source (400); the second light stretching surface (601') diffuses light outward along the length direction of the strip light holder (100) and projects the light onto the illumination surface (200) directly in front of the adjacent first light splitting member (500).

18. The strip light used in showcase as claimed in claim 17, wherein the second light stretching surface (601') focuses the light along a widthwise direction of the strip light holder (100).

19. The strip light used in showcase as claimed in claim 18, wherein the bottom surface of the light stretching member (600) is provided with a third counter bore (603') for accommodating the light source (400), and an inner wall of the third counter bore (603') forms the second light incident surface (602').

* * * * *